US009797114B2

(12) United States Patent
Maifield et al.

(10) Patent No.: US 9,797,114 B2
(45) Date of Patent: Oct. 24, 2017

(54) WORK VEHICLE OPERATOR CONTROL WITH INCREMENT ADJUST

(71) Applicant: Deere & Company, Moline, IL (US)

(72) Inventors: Christopher J. Maifield, Dubuque, IA (US); Nathan J. Horstman, Durango, IA (US); Giovanni A. Wuisan, Epworth, IA (US); Ronald J. Huber, Dubuque, IA (US)

(73) Assignee: Deere & Company, Moline, IL (US)

( * ) Notice: Subject to any disclaimer, the term of this patent is extended or adjusted under 35 U.S.C. 154(b) by 77 days.

(21) Appl. No.: 14/920,585

(22) Filed: Oct. 22, 2015

(65) Prior Publication Data

US 2017/0114522 A1 Apr. 27, 2017

(51) Int. Cl.

| | |
|---|---|
| ***E02F 9/20*** | (2006.01) |
| ***E02F 3/84*** | (2006.01) |
| *E02F 3/76* | (2006.01) |

(52) U.S. Cl.

CPC ..... *E02F 9/2004* (2013.01); *E02F 3/844* (2013.01); *E02F 3/7636* (2013.01)

(58) Field of Classification Search

CPC ..... E02F 9/2004; E02F 3/844; E02F 3/7636
See application file for complete search history.

(56) References Cited

U.S. PATENT DOCUMENTS

| | | | |
|---|---|---|---|
| 6,152,237 | A | 11/2000 | Hartman et al. |
| 7,497,298 | B2 | 3/2009 | Shearer et al. |
| 8,424,632 | B2 | 4/2013 | Ruhter et al. |
| 8,500,387 | B2 | 8/2013 | Trifunovic |
| 8,744,696 | B2 | 6/2014 | Choi |
| 2005/0034549 | A1 | 2/2005 | Braud |
| 2009/0223734 | A1 | 9/2009 | Frett et al. |
| 2011/0276222 | A1* | 11/2011 | Lougheed ..... E02F 9/26 701/33.4 |

OTHER PUBLICATIONS

John Deere, H Series Front Loader, Brochure, Admitted Prior Art.
Volvo, Motor Graders G930B, G940B, G946B, G960B, Product Brochure, EN 22 20025743-C, May 2013.

* cited by examiner

*Primary Examiner* — Anne M Antonucci
(74) *Attorney, Agent, or Firm* — Lorenz & Kopf, LLP

(57) ABSTRACT

A control system for a work vehicle has a controller configured to adjust first and second actuators for moving first and second sides of an implement relative to the work vehicle. A first operator control provides a first incremental input to the controller corresponding to a first incremental adjustment of the first actuator effecting a prescribed change in position of the first side of the implement. A second operator control provides a second incremental input to the controller corresponding to a second incremental adjustment of the second actuator effecting a prescribed change in position of the second side of the implement. At least when in a manual control mode, the incremental change in position of the first side of the implement is independent of the incremental change in position of the second side of the implement.

20 Claims, 10 Drawing Sheets

WORK VEHICLE OPERATOR CONTROL WITH INCREMENT ADJUST

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure relates to operator control of work vehicles, such as motor graders.

BACKGROUND OF THE DISCLOSURE

Heavy equipment operators often operate large work vehicles using various controls mounted at or near an operator station of the vehicle. In complex vehicles, such as motor graders, the operator may be required to manipulate a large number of controls in succession or simultaneously to operate numerous independent or interdependent subsystems of the vehicle. These may include systems that control vehicle heading rate and direction as well as systems that operate one or more tools or implements carried by the vehicle.

Effective and efficient operation of the vehicle and its implements may require the operator to perform intricate, hand and arm gestures in order to manipulate the controls required to activate these systems timely and accurately. Imprecise control of the vehicle and its implements can lead to slow working, or re-working, of the area of interest, or it cause more material (e.g., aggregate, asphalt and so) to be used at the area of interest than desired, which is costly. At times, a number of intricate gestures may be required simultaneously or in rapid succession to operate the vehicle effectively and efficiently (e.g., end of pass U-turns and the like).

SUMMARY OF THE DISCLOSURE

This disclosure provides improved operator control of work vehicles, including motor graders.

In one aspect the disclosure provides a control system for a work vehicle having an implement adjustably mounted to a frame of the work vehicle by a first actuator coupled to a first side of the implement and a second actuator coupled to a second side of the implement. The control system may include a controller configured to adjust the first actuator and the second actuator. A first operator control may provide a first incremental input to the controller corresponding to a first incremental adjustment of the first actuator effecting a prescribed change in position of the first side of the implement. A second operator control may provide a second incremental input to the controller corresponding to a second incremental adjustment of the second actuator effecting a prescribed change in position of the second side of the implement. At least when in a manual control mode, the incremental change in position of the first side of the implement is independent of the incremental change in position of the second side of the implement.

In another aspect the disclosure provides a control system for a work vehicle in which a controller may be configured to adjust the first actuator and the second actuator. A first operator control may provide a first incremental input to the controller corresponding to a first incremental adjustment of the first actuator effecting a prescribed change in height of the first side of the implement. A second operator control may provide a second incremental input to the controller corresponding to a second incremental adjustment of the second actuator effecting a prescribed change in height of the second side of the implement. At least when in a manual control mode, the incremental change in height of the first side of the implement is independent of the incremental change in height of the second side of the implement.

In yet another aspect the disclosure provides a control system for a work vehicle in which a controller may be configured to adjust the first actuator and the second actuator. A first joystick having a first operator control may provide a first incremental input to the controller corresponding to a first incremental adjustment of the first actuator. A second joystick having a second operator control may provide a second incremental input to the controller corresponding to a second incremental adjustment of the second actuator. A third operator control may provide a mode selection input to the controller for changing between a manual control mode and a cross-slope control mode. When the third operator control sets the controller to the manual control mode, the first operator control may be configured to provide a first incremental input to the controller corresponding to a first incremental adjustment of the first actuator effecting a prescribed change in height of the first side of the implement, and the second operator control may be configured to provide a second incremental input to the controller corresponding to a second incremental adjustment of the second side of the second actuator effecting a prescribed change in height of the second side of the implement independent of the change in position of the first side of the implement. When the third operator control sets the controller to the cross-slope control, the first operator control may be configured to provide first and second incremental inputs to the controller corresponding to first and second incremental adjustments of the first and second actuators effecting a prescribed change in height of the implement without changing a slope of the implement between the first and second sides.

The details of one or more implementations or embodiments are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION

Figure 1:
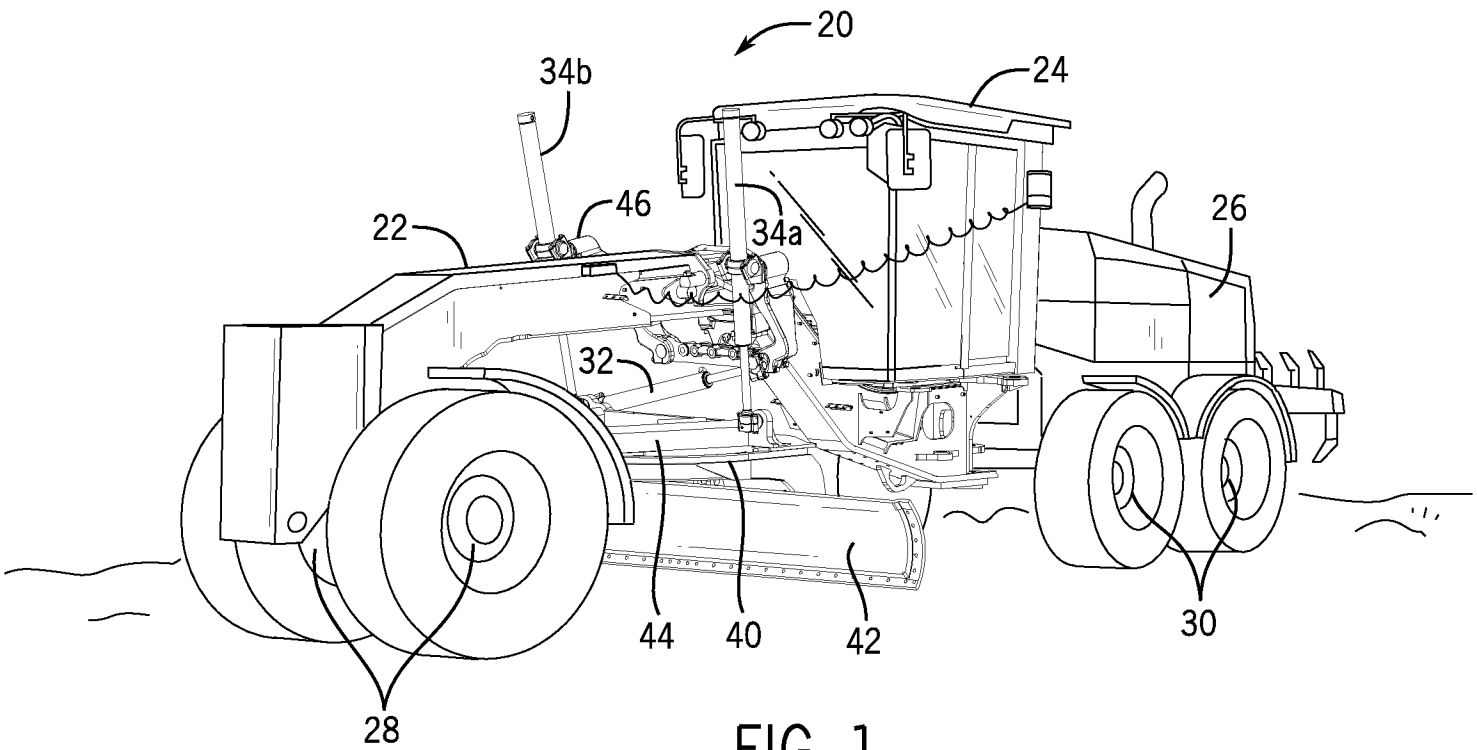
FIG. 1 is perspective view of a work vehicle in the form of a motor grader in which the operator control arrangement of this disclosure may be incorporated.

The following describes one or more example embodiments of the disclosed operator control arrangement, as shown in the accompanying figures of the drawings described briefly above. Various modifications to the example embodiments may be contemplated by one of skill in the art.

Work vehicles used in various industries, such as the agriculture, construction and forestry industries, may include tools, implements or other sub-systems used to carry out various functions for which the work vehicle was designed. Very often this requires the vehicle operator to be familiar with and operate the vehicle controls necessary to both maneuver the work vehicle and operate the work tool or implement. At times, the operator may need to control vehicle heading and speed simultaneously with operation of the implement. Certain work vehicles, such as those with a number of implements or with implements having multiple degrees of freedom in movement, may be rather complex to operate and require the operator to have considerable related skill and experience. Suboptimal operation of the vehicle or the implements may have costly consequences, for example, in terms of inefficient or imprecise performance at the work site causing extra labor and equipment-related costs or waste of materials at the work site before or after the work is undertaken.

One particularly complex work vehicle is the motor grader, which is generally used in the construction industry to set grade. Modern motor graders are typically large machines with a long wheel base in the fore-aft direction of the vehicle. The large platform gives rise to additional maneuverability-enhancing features being added to the machine, separate and apart from conventional heading and speed control features. For example, motor graders may be outfitted with an articulated chassis in which the front section of the chassis having the steered wheels may pivot with respect to a rear section having the drive wheels, which has the effect of shortening the overall wheel base of the machine. Motor graders may also have the capability to tilt the steered wheels off of the rotational axis of the wheels, in other words to lean the wheels, and thus lean the machine and shift the vehicle's heading, toward either side of the machine. These features thus provide for an improved (i.e., shorter) turning radius, making the large machine more nimble than otherwise possible. Beyond the heading and speed control, motor graders may have a rather complex implement control scheme and one or more implements. The primary tool on motor graders is the moldboard or blade, which is mounted to a turntable known in the industry as a "circle". The circle is adjustably mounted to the vehicle frame, and the blade in turn is adjustably mounted to the circle, thus giving the blade a wide-range of possible movements. Specifically, the circle may be able to raise and lower with respect to the vehicle frame to adjust blade height, either uniformly from heel to toe, or independently to tilt the blade with respect to horizontal. The circle may also be able to shift to a lateral side of the vehicle by pivoting about the main frame so that the angular position of the blade about the vehicle's centerline may change, for example, to work embankments or raised ground to a slide of the machine. The circle may also rotate about a generally vertical axis with respect to the vehicle frame in order to change the angular position of the blade about the vertical axis such that the toe end of the blade may be positioned forward of the heel end of the blade in the fore-aft direction at either side of the vehicle frame. The blade may be mounted to shift laterally side-to-side with respect to the circle to move the blade further toward one side of the machine. The blade may also be capable of tilting in the fore-aft direction with respect to the circle to change its pitch. Various combinations of these operations may be undertaken.

To perform all of the aforementioned functions and operations, the motor graders have in the past been outfitted with a relatively large number of mechanical control levers and knobs that may each control operation of a single, discrete operation or motion. In some modern motor graders, the manual mechanical controls have been replaced with electronic controls. Sometimes these controls are arranged in banks of primarily single axis joysticks, which the operator may manipulate forward and backward using his or her fingertips, and which each control a single, discrete function. The operator controls may also be a pair of multi-axis joysticks, which are used to assist control of the vehicle heading and to actuate the circle and blade assembly and other attached implements. A consequence of consolidating the number of controls that need to be manipulated by the operator is that a dual joystick control system requires that a significant number of operations need to be carried out by each joystick, and thus, each joystick must be manipulated along several axes and carry a large number of control inputs (e.g., switches). Apart from the sheer number of control inputs (e.g., switches and joystick movements), some of the operations may need to be performed in a particular sequence or simultaneously. This compounds the possible number of switch and joystick movements that may be required of the operator.

Additionally, certain tool movements and operations require a relatively fine adjustment resolution, in other words, to perform certain operations at the work site an implement may need to be controlled precisely with very slight movements. For example, blade height adjustments may need to be made on the order of fractions of an inch for certain grading operations to be carried out accurately and to reduce waste of materials. In the context of roadway preparation, for instance, positioning the blade too low, even fractionally, may cause significant extra material (e.g., aggregate, asphalt, etc.) to be required to bring the surface to the prescribed grade. This, of course, may have a significant impact on the cost of the project. Arranging the switches and joystick movements of the operator controls suboptimally may not give the operator, especially the inexperienced operator, the requisite control resolution of tool movement necessary to accurately and efficiently perform certain operations.

The following discusses aspects of the disclosed operator controls that address these and other issues, and which are particularly suited for use in large work vehicle platforms with multiple tool features and movements, such as motor graders.

In certain embodiments, the disclosed operator control arrangement includes joystick controls with an ergonomic handle or grip configuration. Various aspects of the joystick grip configuration aid in reducing operator fatigue during use. For example, each joystick may have a palm-on-top style grip, which is shaped to support the operator's palm from underneath. The grips thus serve as palm rests supporting the weight of the operator's hands and arms, so that hand and arm muscles need not be engaged to maintain contact with the controls. The shape (e.g., contour, width, angle with respect to the operator, and so on) of each joystick is configured to follow the natural position of the operator's hands when cupped around the top of the grip and support the full width of the operator's hands. The gradual, generally large-radius contouring of the broad palm rest continues from the rear of the grip (e.g., closest the operator) to the far side of the grip (e.g., the front with respect to the fore-aft direction of the vehicle) where the contouring allows for the operator's fingers to bend over the grip so that the fingertips may engage an underside of the grip. Fore, aft and lateral pivoting of the joystick may be accomplished without tightly grasping the grip. A main control area of each joystick may have a flat face at an inner end of the palm rest that follows the angulation of the palm rest so that the switches at the control area fall within the natural reach of the operator's thumb. Further, other controls may be mounted within reach of the operator's fingers (e.g., index and middle fingers).

In certain embodiments, the disclosed operator control arrangement includes a control set that is generally balanced or evenly distributed across left and right operator controls (e.g., left and right joysticks). In this respect, a "distributed" or "balanced" control set may mean that the physical location of the control switches is more or less evenly distributed between the left and right operator controls. In the case of joystick operator controls, the orientation and number of joystick movements for each operator control may be the same, such as each being configured for rotation about X and Y axes. In this way, each of the operator's hands will be responsible for, and manipulate, the same or a similar number of switches and make the same or similar number of joystick movements during operation of the machine. The disclosed operator control arrangement takes the concept of a balanced control arrangement beyond having a similar, or even the same, switch-count on each operator control to also include consideration of the set of operations effected by the control set of each operator control. For instance, certain operations may be performed more frequently, require more time to perform, or require different hand gestures when compared to other operations. By distributing the control set across both operator controls, and thus both hands, while taking into account both the quantity of the switches and joystick movements and the quantity and types of operations being performed, the likelihood of overloading one hand may be significantly reduced, or even prevented.

In certain embodiments, the disclosed operator control arrangement has a layout of controls and movements that facilitate performing certain operations in a set sequence or simultaneously. The various operations may be classified as a machine control (or positioning) operation (e.g., operations related to the vehicle's heading) or an implement control (or positioning) operation (e.g., blade positioning operations). By arranging the control set of each operator control according to the set of operations each forms, the usability of the machine may be enhanced by coordinating left-hand and right-hand controls for the operations that are commonly performed in a set sequence or simultaneously. To explain, consider a grouping of four (or any number of) operations that are commonly performed either consecutively or simultaneously. This set of four operations could, for example, be mapped to four different switches on the left-hand joystick such that the operator would be required to either sequentially or simultaneously actuate each of the four switches to carry out the four operations. However, instead, the four-operation grouping may be allocated in a balanced arrangement in which two operations are mapped to two switches on each of the left-hand and right-hand joysticks. In this latter case, the operator will not only experience less fatigue in a given hand, but will also be able to more easily carry out the operation grouping in a simultaneous fashion, with less physical movement and contortion of the fingers and hands.

In certain embodiments, the operator control arrangement may also take into account the cycle time for certain operations and provide improved controls that allow the operator to execute certain operations without manipulating the control input (e.g., switch or joystick movement) for the duration of the operation cycle time. For example, various controls may have dedicated control inputs or detent positions that provide discrete control inputs associated with certain vehicle components the operation of which are also controlled according to variable control signals that the control may provide via other control inputs, such as single or multi-axis functionality. The operator may initiate an operation by moving (e.g., rolling or pivoting) the control and either moving it to the detent position or simultaneously activating the dedicated control input, the corresponding discrete control signals may be correlated to a known location in the range of travel of the component being controlled. In some embodiments, at the detent position(s) the control may be moved along a second axis (e.g., depressed) to execute the movement of the controlled component to the known position (or other operation), immediately after which the control may be released prior to completion of the operation cycle time. The fatigue experienced, and the concentration required, by the operator may thus be significantly reduced.

In certain embodiments, the disclosed operator control arrangement is configured to improve the precision and accuracy by which certain operations are carried out. Thus, in addition to improving the user experience by making the operator controls more comfortable, less fatiguing and easier to manipulate, the disclosure provides improved operational control of the work vehicle (and implements). To this end, the control arrangement may include incremental advance functionality (i.e., prescribed distance movements) for various operations. For example, the control arrangement may be configured to allow the operator, at the touch of a button, to move the blade a prescribed distance in one direction. One particularly useful implementation of incremental advance functionality is for adjusting the height of the blade in a motor grader. For example, in one mode of operation, the control arrangement may be configured to advance the blade incrementally by a prescribed change in height up or down, without changing its slope relative to the machine. In another mode of operation, the control arrangement may be configured to allow each end of the blade to be advanced incrementally by a prescribed change in height up or down independently of the other end of the blade, thus permitting a change in slope of the blade in addition to a change in height.

With reference to the drawings, one or more example implementations of the operator control arrangement will now be described. While a motor grader is illustrated and described herein as an example work vehicle, one skilled in the art will recognize that principles of the operator control arrangement disclosed herein may be readily adapted for use in other types of work vehicles, including, for example, various crawler dozer, loader, backhoe and skid steer machines used in the construction industry, as well as various other machines used in the agriculture and forestry industries. As such, the present disclosure should not be limited to applications associated with motor graders or the particular example motor grader shown and described.

Figure 2:
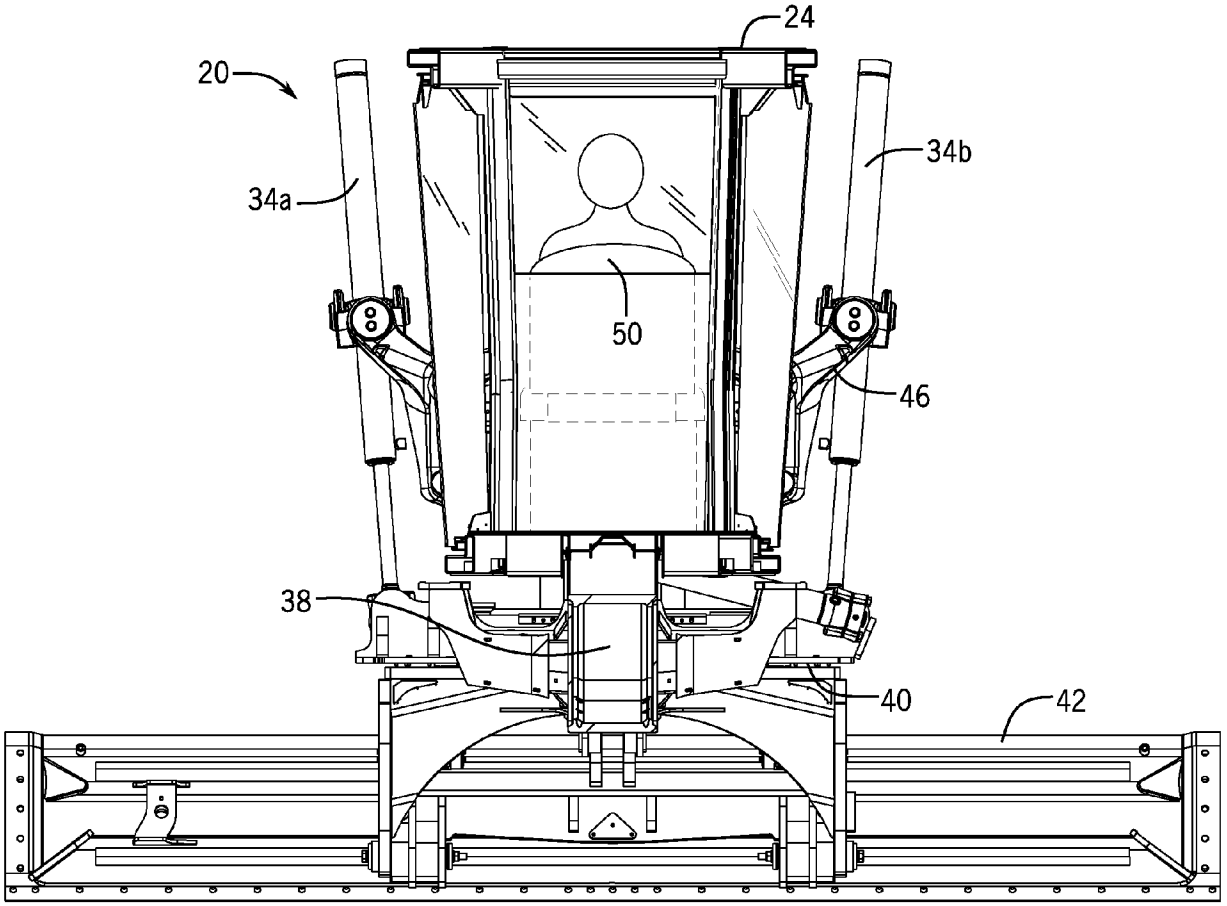
FIG. 2 is a rear view of the motor grader of FIG. 1 showing primarily an operator cabin, main frame and circle and blade assembly thereof.

As shown in FIGS. 1 and 2, a motor grader 20 may include a main frame 22 supporting an operator cabin 24 and a power plant 26 (e.g., a diesel engine) operably coupled to power a drive train. The main frame 22 is supported off of the ground by ground-engaging steered wheels 28 at the front of the machine and by two pairs of tandem drive wheels 30 at the rear of the machine. The power plant may power a hydraulic pump (not shown), which pressurizes hydraulic fluid in a hydraulic circuit including various electro-hydraulic valves, hydraulic drives and hydraulic actuators, including a circle shift actuator 32, lift actuators 34*a* and 34*b*, a blade shift actuator (not shown) and a circle rotate drive (not shown). In the illustrated example, the main frame 22 has an articulation joint 38 between the operator cabin and power plant 26 that allows the front section of the main frame 22 to deviate from the centerline of the rear section of the main frame 22, such as during a turning operation to shorten the effective wheelbase of the motor grader 20, and thus, shorten the turning radius of the machine. The articulation joint 38 is pivoted by one or more hydraulic actuators (not shown).

A circle 40 and blade 42 assembly is mounted to the main frame 22 in front of the operator cabin 24 by a drawbar 44 and a lifter bracket 46, which in certain embodiments may be pivotal with respect to the main frame 22. Cylinders of the lift actuators 34*a*, 34*b* may be mounted to the lifter bracket 46, and pistons of the lift actuators 34*a*, 34*b* may be connected to the circle 40 so that relative movement of the pistons may raise, lower and tilt the circle 40, and thereby the blade 42. The circle 40, via the circle drive and various actuators, causes the blade 42 to be rotated relative to a vertical axis as well as shifted sideways or laterally in relation to the main frame 22 and/or the circle 40.

Figure 3:
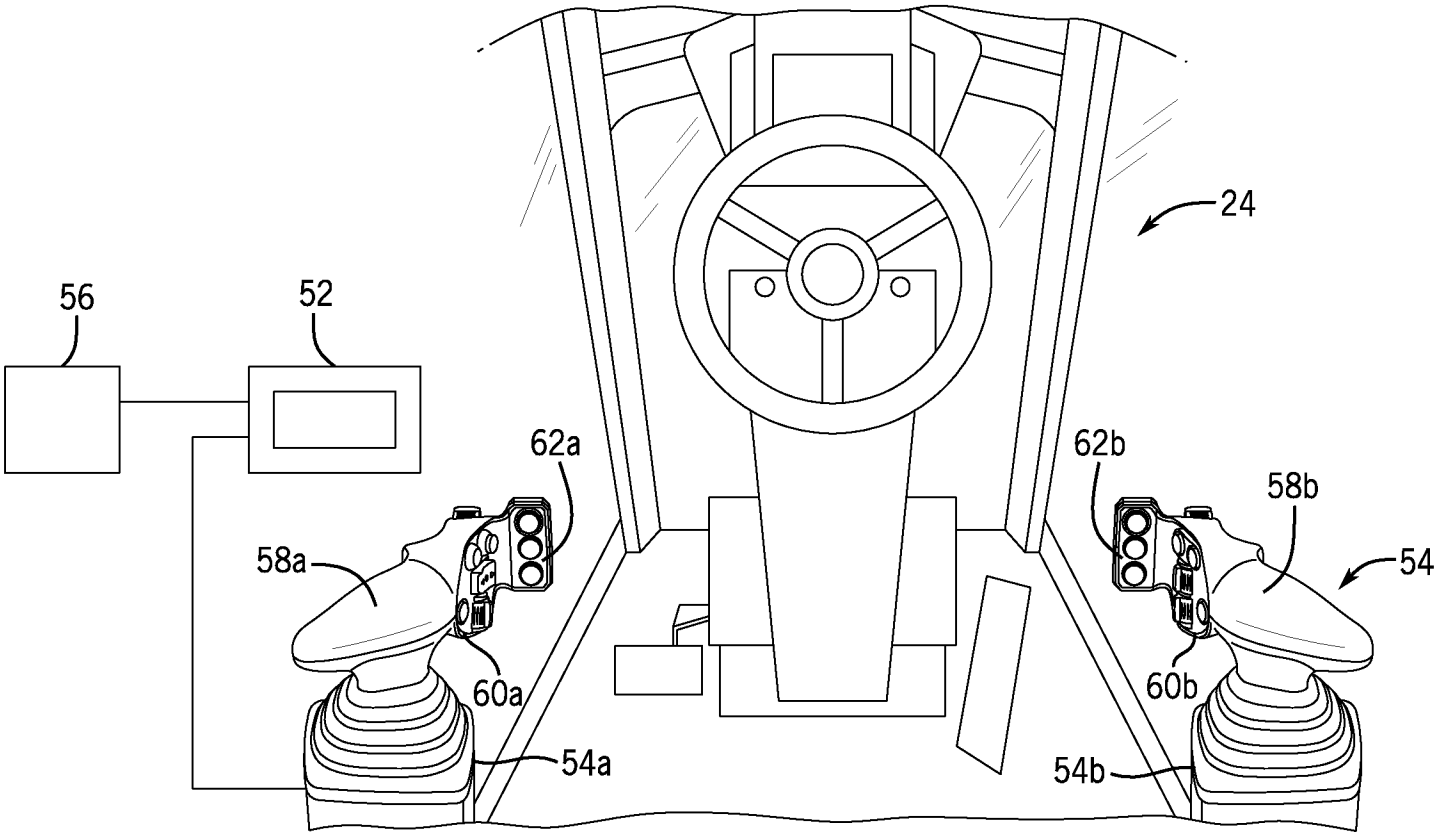
FIG. 3 is simplified view inside an operator cabin of the motor grader of FIG. 1, showing example operator controls.

Referring also to FIG. 3, the operator cabin 24 provides an enclosure for an operator seat 50 and an operator console for mounting various control devices (e.g., steering wheel, accelerator and brake pedals), communication equipment and other instruments used in the operation of the motor grader 20, including a control interface 52 providing graphical (or other) input controls and feedback. Operator controls, including a left operator control ("LOC") 54*a* and a right operator control ("ROC") 54*b* (collectively "the controls 54") are mounted in the operator cabin 24 to each side of the operator seat 50, for example, slightly forward of the arm rest (not shown) of the operator seat 50, comfortably within arms' reach of the operator. In certain embodiments, the operator controls 54 may be joystick controls, such as multi-axis joysticks mounted for pivotal movement about X and Y axes, for example, the "X" axis may be aligned with the side-to-side direction of the motor grader 20, and the "Y" axis may be aligned with the fore-aft direction of the motor grader 20, perpendicular to the side-to-side direction. The joysticks may further be configured to return to center, or a neutral input position, (e.g., by spring bias) when the joysticks are not being manipulated manually.

The control interface 52 and the operator controls 54 are operatively connected to one or more controllers, such as controller 56, shown in FIG. 3. The control interface 52 and the operator controls 54 provide control inputs to the controller 56, which cooperates to control various electro-hydraulic valves to actuate the various drives and actuators of the hydraulic circuit. The controller 56 may provide operator feedback inputs to the control interface 52 for various parameters of the machine, implement(s) or other sub-systems. Further, the control interface 52 may act as an intermediary between the operator controls 54 and the controller 56 to set, or allow the operator to set or select, the mapping or functionality of one or more of controls (e.g., switches or joystick movements) of the operator controls 54.

In certain embodiments, the controller 56 may be programmed or otherwise configured to interpret one or more control inputs from the operator controls 54 as velocity inputs, and then to provide corresponding velocity-based outputs to control the electro-hydraulic valves. As one of skill in the art will appreciate, a velocity-based input and output control scheme tracks not only the binary state of the control input (e.g., positional or on/off state), but also the rate at which the control input was made. For example, in a velocity-based control scheme, the control input processed by the controller 56 takes account of the end position when the joystick is pivoted to as well as the rate at which the joystick was pivoted. The controller 56 may thus receive velocity input commands corresponding to a desired movement of the machine or implement, and the controller 56 may resolve the velocity inputs, possibly in conjunction with inputs from sensors or other actual position-indicating devices, and command one or more target actuator velocities (e.g., depending on the number of actuators required to effect the desire movement) to effectuate the end movement. A short duration joystick movement to a particular position may thus correspond to a relatively quicker and/or shorter movement of the associated actuator to a certain position, than a longer duration joystick movement. One benefit of this type of control scheme is an intuitive sense of control for the operator without requiring a detailed appreciation of the movement envelope of the associated machine or tool, or mapping of its position within the envelope to the joystick movement. Advantageously, in this type of system, control of each of multiple actuators may be aggregated by the controller to effect the desired movement, rather than requiring the operator to input distinct actuator commands for each discrete actuator. Another benefit of a velocity-based control scheme is that it allows the operator to make the intended control input (e.g., joystick movement) and then let the control (e.g., joystick) to return to center without continuing to hold the joystick in the desired position until the actuator movement cycle time is completed, as may be required in a position-based control scheme. Of course, it should be understood that the disclosed operator controls may have one or more (even all) of the control inputs configured according to a position-based control scheme.

Figure 5:
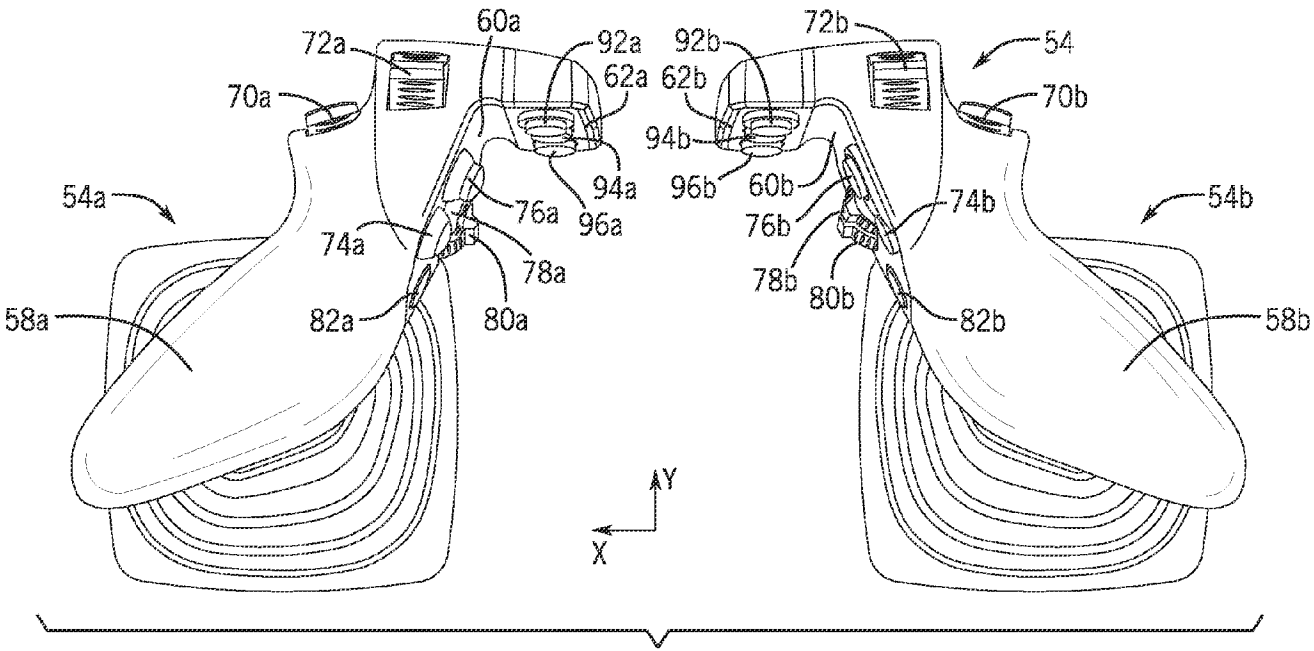
FIG. 5 is a top view of the left and right operator controls of FIG. 2.
Figure 6:
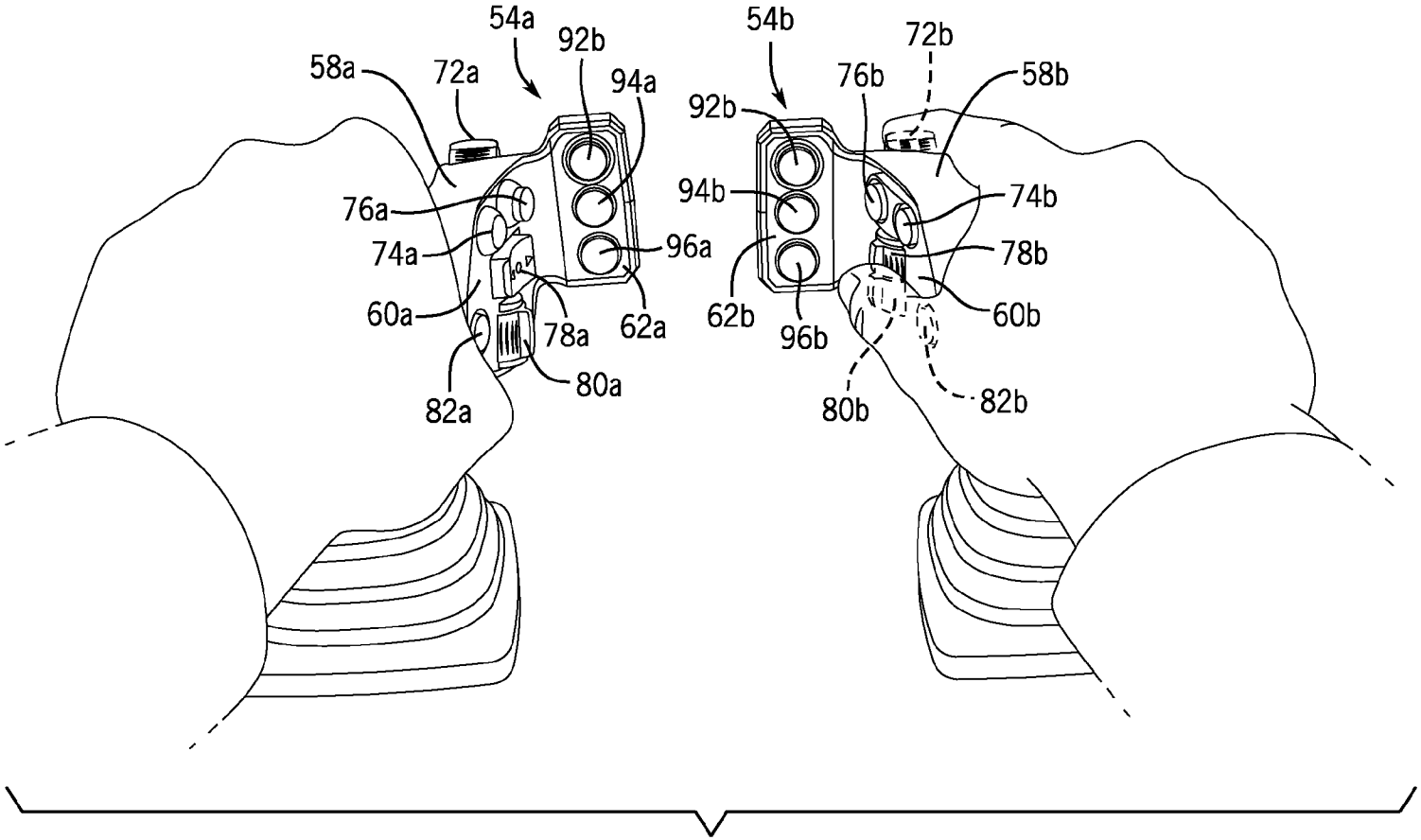
FIG. 6 is a rear perspective view showing the operator controls of FIG. 2 in the hands of an operator.

Referring also to FIGS. 5 and 6, for added comfort and to reduce operator fatigue, in certain embodiments, the controls 54 may have ergonomic grips 58*a*, 58*b* in the palm-on-top style in which the grips 58*a*, 58*b* form palm rests. The controls 54 support the weight of the operator's hands and arms so that the operator's hand and arm muscles need not be engaged to maintain contact with the controls. The shape of the grips 58*a*, 58*b*, are configured to follow the natural position of the operator's hands when cupped around the top of the grips 58*a*, 58*b*, and to support the full width of the operator's hands. The gradual, generally large-radius contouring of the broad palm rest continues from the rear of the grip (e.g., closest the operator) to the far side of the grip (e.g., the front with respect to the fore-aft direction of the vehicle) where the contouring allows the operator's fingers to bend over the grip so that the fingertips engage an underside of the grips 58*a*, 58*b*. Fore, aft and lateral pivoting of the controls 54 may be accomplished without tightly grasping the grip, in particular, using relative light pressure from the fingers and thumbs to pull and push the controls 54 back and forth about the X axis and side-to-side about the Y axis. Main control areas 60*a*, 60*b* of the controls 54 (mounting some of the control switches, as described below) each have a flat face at an inner, distal end of the grips 58*a*, 58*b* that follows the angulation of each of the grips 58*a*, 58*b* so that the switches at the control areas 60*a*, 60*b* fall within the natural reach of the operator's thumbs (e.g., being about 30-45 degrees inward from the Y axes of the controls 54 (from the perspective of the top view of FIG. 5). Other controls may be mounted within reach of the operator's index and middle fingers. The generally horizontal palm-on-top grip configuration of the controls 54 may significantly reduce strain and fatigue on the operator compared to certain conventional controls, such as any number of controls with generally vertically-oriented pistol-grip style joysticks.

In certain embodiments, the controls 54 have prescribed control sets that are selected and arranged to enhance the operator experience and the control of the motor grader 20. Generally, the control sets may be evenly distributed between the LOC 54*a* and the ROC 54*b* to give the operator a balanced experience in which both hands share the control duty more or less evenly such that one hand is less likely to be overloaded and fatigue prematurely. The control sets may also be selected and arranged to facilitate certain long-cycle time operations or complex or multi-step operations that may require multiple control inputs to be executed in a specific sequence or simultaneously. Further, the control sets may include one or more inputs to facilitate more precise control of certain short-motion adjustments that may otherwise cause the operator to under- and over-adjust before making the intended adjustment.

Figure 4B:
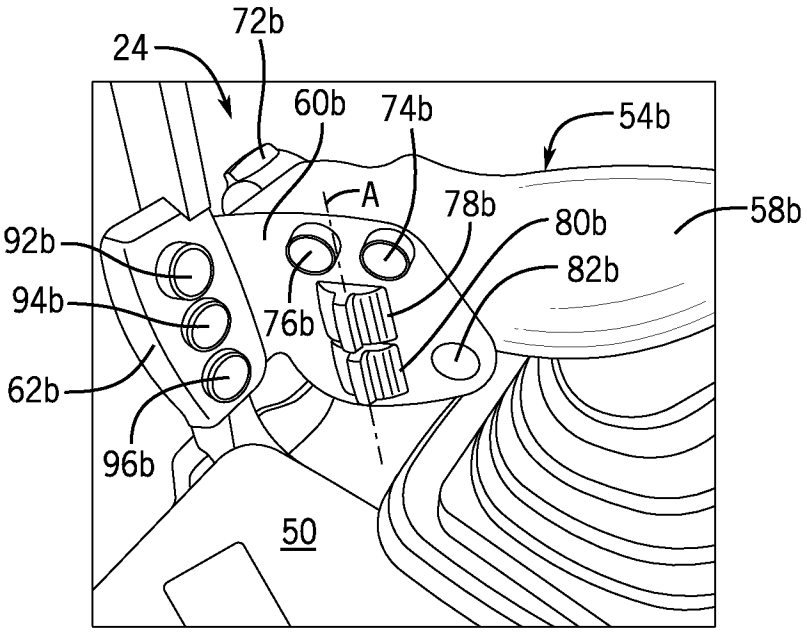
FIGS. 4A and 4B are perspective views of the of the respective left and right operator controls of FIG. 2.
Figure 4A:
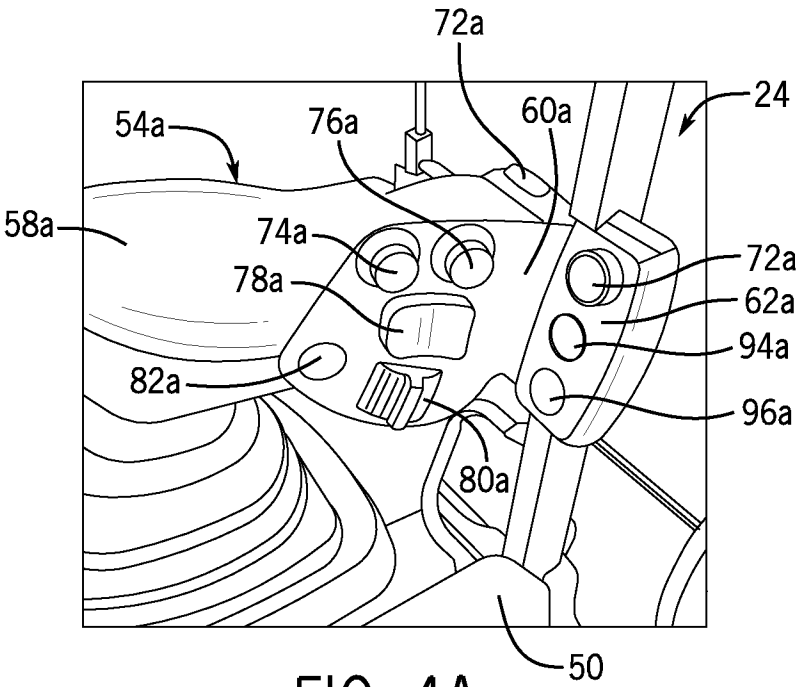

Referring now to FIGS. 4A, 4B and 5, example control sets for the LOC 54*a* and the ROC 54*b* will be described that provide a more evenly distributed, left-hand, right-hand balanced layout for the operator. It should be understood that the specific switch types, switch positions, and switch functions (as well as the joystick movements and functions) may differ for the motor grader 20 or for other work vehicles. In the illustrated example, the LOC 54*a* and the ROC 54*b* each have a consistent number and placement of control switches and functions associated with pivotal movements along the X and Y axes.

In the illustrated example, the LOC 54*a* has a circle shift control 70*a* and an auxiliary implement control 72*a* (e.g., for a ripper attachment) located at a forward area of the grip 58*a* that are within the natural reach of the index and middle fingers, respectively, of the operator's left hand. The circle shift control 70*a* and the implement control 72*a* may each be a proportional roller type switch with a protruding "paddle" feature and that is spring-biased to return to center (i.e., a neutral input position). By way of example, when the operator moves the roller control of the circle shift control 70*a* forward (away from the operator), the controller 56 may actuate the circle shift actuator 32 to pivot the lifter bracket 46 about the main frame 22 to swing the circle 40, and thereby the blade 42, out to the operator's right side. Moving the roller control in the opposite direction (toward the operator) may swing the circle 40, and the blade 42, to the operator's left side.

The control area 60*a* has an array of controls that are within reach of the operator's left thumb, all within a comfortable sweep angle of 45 degrees or so. At the upper part of the control area 60*a* are gear down 74*a* and gear up 76*a* controls, below that is a transmission control 78*a*, and below that is a circle rotate control 80*a*. Another control, such as undefined control 82*a*, may be located inward of the transmission control 78*a* and the circle rotate control 80*a*. The gear down 74*a* and gear up 76*a* controls may each be spring-biased push-button type switches that return to their original position after being depressed. For added comfort and usability, the gear down control 74*a* may project a shorter distance from the control area 60*a* than the gear up control 76*a* so as not to interfere with the operator's ability to reach the farther out gear up control 76*a*, and/or so as not to be inadvertently depressed. The transmission control 78*a* may be a three-position rocker switch, including a central "neutral" transmission position between "forward" and "reverse" transmission positions. The circle rotate control 80*a* may be a proportional roller control, for example, rotating the circle 40, and thereby the blade 42, clockwise by moving the switch forward or away from the operator, and rotating the circle 40 and the blade 42 counter-clockwise by moving the switch rearward. The control 82*a* may be a spring-biased push-button switch that may be operator assignable via the control interface 52. The control 82*a* may also be recessed, essentially flush with the control area 60*a*, so to not interfere with the operator's reach to the other controls and/or be inadvertently depressed.

Figure 5B:
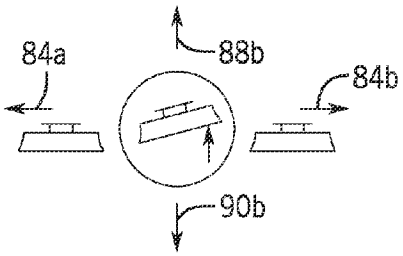
FIGS. 5A and 5B are graphic representations of example functions for movement of the respective left and right operator controls about X and Y axes.
Figure 5A:
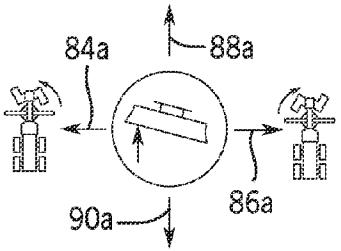

As illustrated schematically in FIG. 5A, pivoting the LOC 54*a* about the Y axis may generate a steering input to the controller 56 for turning the steered wheels 28, and thereby controlling the heading of the motor grader 20. For example, pivoting the LOC 54*a* to the left of the Y axis may provide a left turn control 84*a*, and pivoting the LOC 54*a* to the right of the Y axis may provide a right turn control 86*a*. Pivoting the LOC 54*a* about the X axis may control the height of the left end of the blade 42 (e.g., by raising and lowering the left side of the circle 40). For example, pivoting the LOC 54*a* forward with respect to the X axis may generate a left end blade lift control 88*a*, and pivoting the LOC 54*a* rearward with respect to the X axis may provide a left end blade lower control 90*a*. The LOC 54*a* may be pivoted about the X and Y axes simultaneously to effect the noted inputs and actuations simultaneously, and the LOC 54*a* may be biased to return to center (i.e., a neutral input position).

The ROC 54*b*, in the illustrated example, has a blade pitch control 70*b* and an auxiliary implement control 72*b* (e.g., for a scarifier attachment) located at a forward area of the grip 58*b* that are within the natural reach of the index and middle fingers, respectively, of the operator's right hand. The blade pitch control 70*b* and the implement control 72*b* may each be a proportional roller type switch with a paddle and that is spring-biased to return to center (i.e., a neutral input position). For example, when the operator moves the roller control of the blade pitch control 70*b* forward (away from the operator), the controller 56 may cause the blade actuator(s) to tilt an upper edge of blade 42 forward with respect to its lower edge. Moving the roller control in the opposite direction (toward the operator) may cause the blade 42 to tilt the upper edge rearward with respect to its lower edge.

Similar to the control area 60*a*, the control area 60*b* has an array of controls that are within reach of the operator's right thumb. At the upper part of the control area 60*b* are a chassis return to center control 74*b* and a differential lock 76*b* control, below that is an articulation control 78*b*, and below that is a wheel lean control 80*b*. Another control, such as undefined control 82*b*, may be located inward of the articulation control 78*b* and the wheel lean control 80*b*. The chassis return to center control 74*b* and the differential lock control 76*b* may each be spring-biased push-button type switches that return to their original position after being depressed. Like on the LOC 54*a*, these switches may project different distances from the control area 60*b* so as not to interfere with the operator's ability to reach the farther out switch, and/or so that the nearer switch is not inadvertently depressed. The articulation control 78*b* and the wheel lean control 80*b* may each be a proportional roller type switch with a paddle and that is spring-biased to return to center (i.e., a neutral input position), and the control 82*b* may be a recessed, push-button switch that may be operator assignable via the control interface 52.

As illustrated schematically in FIG. 5B, pivoting the ROC 54*b* about the Y axis may generate a blade shift input to the controller 56 for moving the blade 42 laterally left and right. For example, pivoting the ROC 54*b* to the left of the Y axis may provide a left blade shift control 84*b*, and pivoting the ROC 54*b* to the right of the Y axis may provide a right blade shift control 86*b*. Similar to the LOC 54*a*, pivoting the ROC 54*b* about the X axis may control the height of the right end of the blade 42 (e.g., by raising and lowering the right side of the circle 40). For example, pivoting the ROC 54*b* forward with respect to the X axis may provide a right end blade lift control 88*b*, and pivoting the ROC 54*b* rearward with respect to the X axis may provide a right end blade lower control 90*b*. Also similar to the LOC 54*a*, the ROC 54*b* may be pivoted about the X and Y axes simultaneously to effect the noted signals and actuations simultaneously, and the ROC 54*b* may be biased to return to center (i.e., a neutral input position).

In certain embodiments, the controls 54 may have supplemental control areas for additional controls. Like the other controls, the additional controls are located within a comfortable, natural finger or thumb reach. In the illustrated example, the LOC 54*a* and the ROC 54*b* may have control areas 62*a*, 62*b*, which may be integrally formed with the grips 58*a*, 58*b*, or may be mounted to the grips 58*a*, 58*b* as separate attachments. In either case, the control areas 62*a*, 62*b* may be arranged near or adjacent to, and either in-line or at an angle to (as illustrated), the associated control area 60*a*, 60*b* within reach of the operator's left or right thumb. In the illustrated example, the control areas 62*a*, 62*b* have a set of controls related to an integrated grade control ("IGC") functionality of the motor grader 20, including an IGC mode control 92*a*, 92*b*, an IGC up control 94*a*, 94*b* and an IGC down control 96*a*, 96*b*, each set being arranged in a column, one above the other. The IGC-related controls may each be a spring-biased push-button switch. As will be understood by one of skill in the art, the IGC functionality assists the operator in keeping the blade 42 level or at a particular slope from heel to toe. The IGC is activated and deactivated by depressing either IGC mode control 92*a*, 92*b*. Once depressed, the controller 56 sets up a master-slave control relationship in which the LOC 54*a* or the ROC 54*b* associated with which IGC mode control 92*a*, 92*b* was depressed, acts as the master, and the other acts as the slave. In this way, the IGC up control 94*a*, 94*b* and IGC down control 96*a*, 96*b* specified as the master may be used to raise or lower the circle 40, and thereby the blade 42, at the associated side (i.e., left or right) of the machine by actuating the associated lift actuator 34*a*, 34*b*. The other, slave set of IGC up/down controls will be disabled temporarily and the controller 56 will control the associated lift actuator as needed to maintain the slope of the blade 42 in the state it was before the IGC mode was activated. The IGC mode may be canceled by depressing either IGC mode control 92*a*, 92*b* while already in the IGC mode. In a manual mode, the IGC up control 94*a*, 94*b* and IGC down control 96*a*, 96*b* may be used to raise and lower the circle 40 and blade 42, including to make changes to the slope of the blade 42. Additional aspects of the IGC control scheme will be described in detail below.

In the illustrated example, the controls 54 exhibit a balanced control set for the operator both in terms of switch-count and operative functionality. Specifically, the switch-count of the LOC 54*a* and the ROC 54*b* is the same, at fourteen per operator control, including on each: two controls (70*a/b*, 72*a/b*) at the front side of the grip 58*a*, 58*b*, five controls (74*a/b*, 76*a/b*, 78*a/b*, 80*a/b*, 82*a/b*) at the control areas 60*a*, 60*b*, three controls (92*a/b*, 94*a/b*, 96*a/b*) at the control areas 62*a*, 62*b*, and four joystick movement controls (84*a/b*, 86*a/b*, 88*a/b*, 90*a/b*). Furthermore, the control inputs may be classified by operation to further refine the selection of the control sets for each of the LOC 54*a* and the ROC 54*b*. For example, the control inputs may be classified as either for positioning the machine or for positioning an implement. In the illustrated example, setting aside the undefined controls 82*a*, 82*b*, the LOC 54*a* has five machine-positioning control inputs (74*a*, 76*a*, 78*a*, 84*a*, 86*a*) and eight implement-positioning control inputs (70*a*, 72*a*, 80*a*, 88*a*, 90*a*, 92*a*, 94*a*, 96*a*), which gives the LOC 54*a* about a 1:2.6 machine-to-implement ratio. The ROC 54*b* has four machine-positioning controls (74*b*, 76*b*, 78*b*, 80*b*) and nine implement-positioning control (70*b*, 72*b*, 84*b*, 86*b*, 88*b*, 90*b*, 92*b*, 94*b*, 96*b*), which gives the ROC 54*b* about a 1:3.2 machine-to-implement ratio. Thus, the example controls 54 distribute the control set so that the same number of controls are manipulated by each hand, and further that each hand effects a similar ratio of machine-positioning control inputs to implement-positioning inputs. This balanced or distributed feel contributes to an improved operator experience and reduced fatigue.

As the example controls 54 illustrate, the disclosure provides a balanced control experience for the operator without requiring exact left-hand, right-hand symmetry in the ratio of machine-positioning controls (or inputs) to the implement-positioning controls (or inputs). Also, while the switch-count is the same for the LOC 54*a* and the ROC 54*b*, a balanced control experience may be provided to the operator without exact identity in switch-count. Moreover, it should be understood that the specific number of control inputs on each control, and the ratio of types of operations of the control inputs, may vary due to a variety of factors. For example, the particular vehicle platform, the number of implements, and the number of operator-controllable components of the machine or implement(s), may require a different allocation of control inputs. The types of switch hardware for the control inputs (e.g., single-function or multi-function switches) may mean that different quantities of switches may be used for each control. Still further, other metrics for evaluating the balanced nature of the control set may be used. For example, rather than switch-count (i.e., quantity of switch hardware), the number of operations that each control is capable of carrying out (i.e., quantity of functional operations) may be considered for comparison. For instance, in the illustrated example, the LOC 54*a* includes controls for seven machine-positioning operations and eleven implement-positioning operations, and the ROC 54*b* includes controls for six machine-positioning operations and eleven implement-positioning operations. This technique may be useful to account for differences in the switch hardware selection. Also, different classifications or more sub-classifications could be used, as could assigning each control input, or operative function, a weighting that takes into account an estimated amount of use (e.g., quantity or duration of inputs) each control is likely to encounter during a prescribed period the machine is operated to perform a prescribed task.

Thus, while as noted, exact identity is not required, for purposes of this disclosure a control set distribution may generally be considered balanced when any of the following conditions exist, namely, (i) the overall number of controls (or inputs), the number of machine-positioning controls (or inputs), or the number of implement-positioning controls (or inputs) on the left-hand and right-hand operator controls vary by no more than a 1:2 ratio (or 50 percent), or (ii) the ratios of machine-positioning controls (or inputs) to implement-positioning controls (or inputs) ("machine-to-implement ratio") on the left-hand and right-hand controls vary by no more than a 1:2 ratio (or 50 percent). Further refined control arrangements may have a machine-to-implement ratio for each operator control of at least 1:4 (or 25 percent).

As noted above, the controls 54 provide a particularly well-balanced arrangement in that the overall number of controls are the same for the LOC 54*a* and the ROC 54*b*, and the difference of each of the number of machine-positioning control inputs and the number of implement-positioning control inputs differ by only a single input, five and eight for the LOC 54*a* compared to four and nine, respectively, for the ROC 54*b*. The machine-to-implement ratios are also very closely associated, at 1:2.6 (or about 38%) for the LOC 54*a* and 1:3.2 (or about 30%) for the ROC 54*b*, which is a difference of only 1.2:1 (or about 8%).

Apart from a balanced control arrangement, the disclosed operator controls may include features that enhance the ability and ease with which the operator carries out certain operations. This is particularly advantageous where certain operations are executed frequently or repetitively, require prolonged cycle times to execute, and/or are operationally complex, such as requiring a number of control inputs be made simultaneously or in particular sequence consecutively. The following is one example in the context of the motor grader 20 of how the disclosed control arrangement provides the operator with improved operational control of the heading of the machine. It should be understood that the control arrangement may provide similar operator enhancements in controlling other aspects of the motor grader or other vehicle platforms.

Figure 7B:
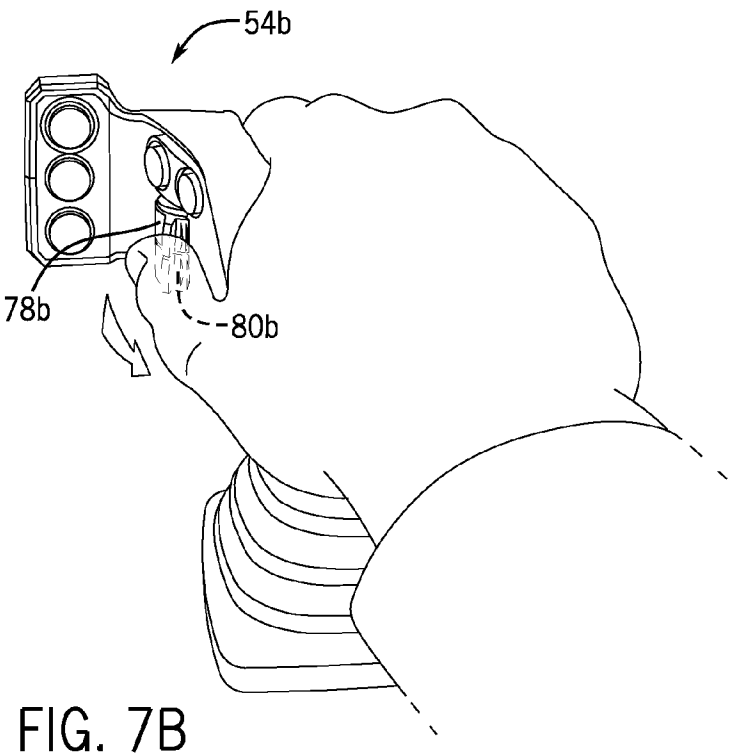
FIGS. 7A and 7B are rear perspective views showing the right operator control with the operator's thumb actuating two switches simultaneously using a single forward or rearward thumb movement.
Figure 7A:
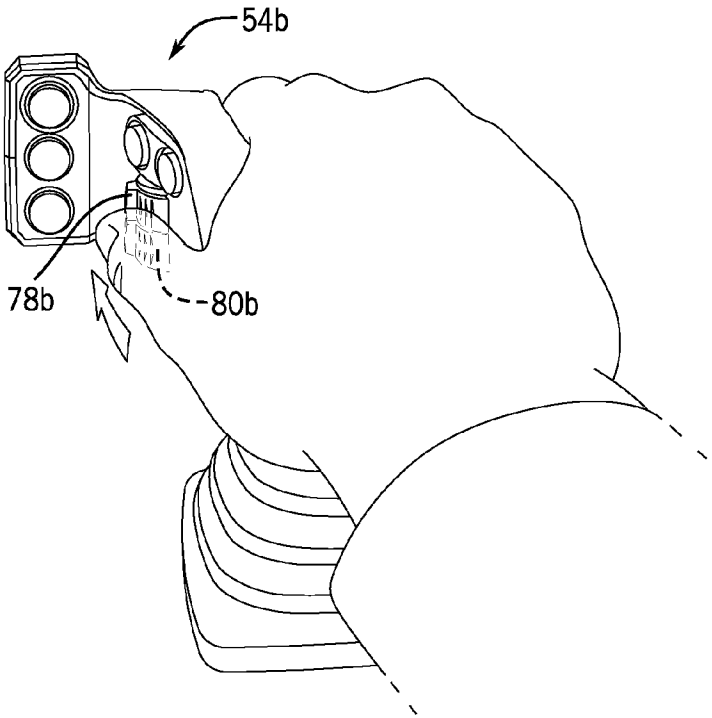

Referring now to FIGS. 4B and 7A-7B, the arrangement and configuration of the articulation control 78*b* and the wheel lean control 80*b* on the ROC 54*b* provides improved operational functionality of the type mentioned in the preceding paragraph. The example control arrangement locates these controls in close proximity in the control area 60*b* of the ROC 54*b*, which allows the operator to quickly access one or both of these controls. Further, each of these controls may be configured as a bi-directional paddle roller control, thus providing in a single control (rather than two separate controls) both actuation directions, and they are positioned side-by-side to pivot about the same, or a similarly-oriented, roller axis A (FIG. 4B). These attributes allow the operator to engage both controls using a single-motion thumb gesture, in particular, either pushing the controls away from the operator (FIG. 7A), and thus effecting a counter-clockwise articulation and leftward wheel lean, or pulling the controls rearward (FIG. 7B), effecting a clockwise articulation and a rightward wheel lean. It should be noted that other switch hardware could be used to implement this control arrangement. For example, the rollers for the articulation and wheel lean controls could be replaced by mini-dual axis joysticks; however, unintended cross-talk between the two functions may be more likely to occur when only a single operation (articulation or wheel lean) is intended.

By giving consideration to the operations executed by the controls in this manner, the intelligent layout of the disclosed control arrangement makes the controlling the heading of the motor grader 20 easier by, in effect, reducing two separate, but often overlapping, machine-positioning operations, and control inputs therefor, to one. Moreover, this improved arrangement is further enhanced by locating the articulation control 78*b* and the wheel lean control 80*b* on the joystick (LOC 54*a*) opposite from the joystick (ROC 54*b*) that controls wheel steering. In this way, a left-hand, right-hand split-duty control scheme is provided for the common operation of turning the motor grader 20 around, or otherwise turning the motor grader 20 with as tight of a turning-radius as possible.

It should be noted that the in certain vehicles the cycle time for an articulation operation may differ from the cycle time for a wheel lean operation, for example, a complete articulation cycle may take five seconds or more, while a wheel lean cycle may be closer to one second. The controller 56 and/or the hydraulic system may be configured to accommodate for different cycle times during simultaneous activation of the articulation control 78*b* and the wheel lean control 80*b*, for example, by initiating a counter and terminating the control signal to the wheel lean actuator(s) after a predetermined time period.

Other operational enhancements to the operator experience may be provided by the disclosed control arrangement. In certain embodiments, various position setting functionalities of the operator control arrangement may be achieved using separate controls to control a single positioning component, for example, one control (e.g., a roller or joystick control) providing a range of continuous or variable control inputs to control a positioning component through a range of motion and another control (e.g., a push-button control) providing a discrete control input to move the positioning component to a preselected reference position.

Alternatively or additionally, the operator control arrangement may have one or more controls capable of combining these (and other) functions into a single control. For example, one or more of the multi-functional controls, may include one or more detent positions that may correlate to a specific function or a reference location in a range of movement (e.g., an extreme (end of travel) position or a center position) of a positioning component of the machine or an implement. The term "detent" (and derivatives) as used herein shall include a physical location in one or more primary ranges of motion of the control that corresponds to a location at which the control may initiate a prescribed discrete control function, with or without tactile feedback to the operator, including a location where the control may undergo one or more secondary ranges of motion. For example, this may include a roller or linear control that has a primary range of motion about a roller axis or along a translation axis, and which may be moved to (or past) the detent position by continuous movement about the roller axis or along the translation axis. As another example, this may include a roller or linear control that may move along a secondary (or "button" or "depression") axis at the detent position that differs from the roller or translation axis. The operator control arrangement may utilize any of one or more of various switch hardware configurations for the operator controls. For example, the controls may include single- or multi-axis joysticks, levers, push-button and toggle switches, sliding or linear switches and rollers of various types, including pivoting and continuously rolling controls. Use of detents in this manner may reduce or eliminate the need for the operator to hold the controls for the duration of the cycle time for a particular operation. This not only reduces stress and strain on the operator's hands, but reduces the amount of time and concentration spent by the operator in carrying out the associated operation.

Thus, the control may control the operation of a component with a range of continuous or variable control signals using one control input mechanism (e.g., a roller or joystick) as well as with one or more discrete control signals, using one or more dedicated buttons or one or more detents in the variable control input mechanism, that are associated with the component that is controlled according to the variable control signals. Further, the functionality provided by the discrete control signals, and thus of the associated buttons or detents, may vary or change depending on the state of the control input providing the variable control signals. For instance, if the control input is a roller or a joystick capable of moving within one or more ranges of motion, the functionality of the discrete input may vary when the roller or joystick is moved into a forward range of motion compared to when the roller or joystick is moved to a rearward range of motion.

It should be noted that while range controls provide certain advantages, as will be described below, in various applications push button controls (e.g., one, or pairs or other groupings of push button controls) may be used. Push button controls may take various forms. For example, push button controls may provide proportional inputs that simulate range controls by providing variable control signals in proportion to the position of the button (e.g., how far it is depressed). The push button (and the control system) may be configured so that a full depression of the button corresponds to a discrete control input. Thus, for example, the button may be used to provide proportional position control of a machine component as well as discrete position control (e.g., end of travel positioning) of the component. Alternatively, the button may be a two-step button in which a variable control (or first discrete control) is provided during a first step of the button motion (e.g., an intermediate or half-way depressed state of the button) and a discrete (or second discrete) control is provided during the second step (e.g., a fully despressed state of the button). Other button arrangements may be utilized in which single or multiple actuations provide different discrete controls (e.g., one "click" to move the component to a first position and two clicks to move the component to a second position). By combining multiple of these buttons, a component may be positioned in multiple degrees of freedom. For example, one button may move a component in a first direction (e.g., clockwise or leftward) and another button may move that component in a second direction (e.g., an opposite direction, such as counter-clockwise or rightward). Each button may provide a variable input and a discrete input so that the component may be positioned continuously or moved to a pre-selected position in each direction (e.g., each end of travel).

In one example, a joystick control may have a forward range of motion providing a range of variable control signals that correspond to counter-clockwise pivoting of a articulation joint of a motor grader, and to the opposite side of a center or neutral position, a rearward range of motion providing variable control signals that correspond to clockwise pivoting of the articulation joint. At the end of each range of motion, the joystick may have a detent at which the joystick provides a discrete control signal associated with a certain reference angular position of the articulation joint, for example, the forward detent orienting the articulation joint to an extreme counter-clockwise angular orientation and the rearward detent orienting the articulation joint to an extreme clockwise angular orientation. A similar arrangement could be provided using a pair of buttons to provide the discrete control input rather than the detent. Now, rather than having multiple detents or buttons, the joystick could have a single button or detent (e.g., a center press or a z-axis push, pull or twist) for providing the necessary discrete control inputs. In this example, when the joystick is in the forward range of motion (for pivoting the articulation joint counter-clockwise), the single detent or button could provide the discrete control signal needed to move the articulation joint to the extreme counter-clockwise orientation, and when the joystick is in the rearward range of motion (for pivoting the articulation joint clockwise), the single detent or button could provide the discrete control signal needed to move the articulation joint to the extreme clockwise orientation. Actuating the button or the detent when the joystick is in a center or neutral position (thus a third range or position relative to the forward and rearward ranges of motion), may effect yet another, different operation, such as moving the articulation joint to a center orientation, midway between the counter-clockwise and clockwise extreme positions. By way of further example, a chassis return to center control (such as control 74*b*) may provide the discrete control input necessary to position the articulation joint in each of the center and two extreme orientations when the joystick is in the neutral position and the forward and rearward ranges of motion, respectively.

Rather than directly effecting a change of position of the controlled component, the discrete input (e.g., detent or button) may also be used for indirect positioning of the component by changing the operative state of the component itself or of another control or positioning component associated with the controlled component. The discrete input may be used, for example, to provide a "mode" selection input to effect such a change in operative state. As one example, the mode selection may pertain to a "float" mode or function of an actuator or control valve in a hydraulic system in which hydraulic fluid is allowed to move between the component and actuator or valve, absent control pressure, such that gravity or other external forces may act on the component to change its position. Other mode selections or indirect positioning may be provided as well.

The operator control arrangement may have multiple controls with discrete button or detent functionality dedicated to control a single, specific positioning component. For example, the articulation control 78*b* and wheel lean control 80*b* (among others) may each have switch hardware with a detent feature. Alternatively, a single discrete button or detent control may be used to control multiple positioning components. For example, only one of the articulation 78*b* and wheel lean 80*b* controls may have a detent feature, in which case the control system may be programmed so that the detent functionality applies to both positioning components (e.g., the articulation joint actuators or the wheel lean actuators) such that both components may be moved to preselected positions by a single detented control. Articulation and wheel lean is one particularly advantageous example where control functionality may be paired to achieve operator control efficiencies using a single detented control, however, other components may benefit in a similar manner.

As noted, while a roller control is not the only type of switch that may have a detent, the added functionality may be beneficial for roller controls. Rollers controls may be configured to rotate continuously about a rotation axis in one or both rotational directions, or to pivot in one or both rotational directions through a reference pivot angle, such as angle γ in FIG. 12. In either case, one or more detent positions may be located anywhere within the ranges of motion of the roller controls, including within the full 360 degrees or within the reference pivot angle. For example, the roller controls may each have a detent at a center position of the associated control, which may be at the midpoint in its pivotal (e.g., forward and rearward) ranges of motion about the roller axis (e.g., roller axis A). The controller 56 may be configured to correlate the detent positions of the roller controls with certain positional conditions or postures of the positioning components of the machine or implement. More specifically, a detent position may correlate to a reference position of the associated machine- or implement-positioning component within the range of travel of the component. A center detent position may thus correlate to a reference position corresponding to a center position of the positioning component. Other detent positions may correlate to end of travel reference positions, or any of various intermediate reference positions, of the positioning component. In some cases, the center detent position may correspond to an inactive condition of the control and a neutral condition of the positioning component. Further, it should be understood that the end of travel positions may correspond to actual mechanical limits in movement of the positioning components, which readily relates to certain components, such as hydraulic cylinders, steered wheels, the articulation joint and so on. However, the end of travel positions may also correspond to functional limits in movement of the positioning components, such as limits to circle rotation or blade angle, to prevent interference with other components of the machine. In the latter case, rotary actuators (e.g., motors) may be used to position rotating components (e.g., a circle) which do not have actual, physical ends of travel. In this case, the controller 56 of the operator control arrangement may be programmed to define virtual end of travel positions of the associated components, for example, corresponding to prescribed rotation counts or cycle times of the associated actuators.

Various example applications will now be described in the motor grader context in relation to control of various machine- and implement-positioning components, including an example detented roller control arrangement for controlling articulation and wheel lean. A center detent of the articulation control 78*b* may correspond to a center position of the actuator(s) for the articulation joint 38, and thereby a straight forward heading and posture of the motor grader 20. The center detent of the wheel lean control 80*b* may correspond to a center position for the actuator(s) for the steered wheels 28, and thereby a straight forward heading and upright posture of the motor grader 20. The articulation control 78*b* and the wheel lean control 80*b* may each also have detents at the end of travel positions of the roller control, one on each side of a center or neutral position, which may correspond to extreme left and right end of travel positions of the articulation joint 38 and steered wheels 28 and associated actuators. One or more other detents within its range or ranges of motion, such as in intermediate positions between the center and extreme detents, may be incorporated into the roller controls as well.

Figure 12:
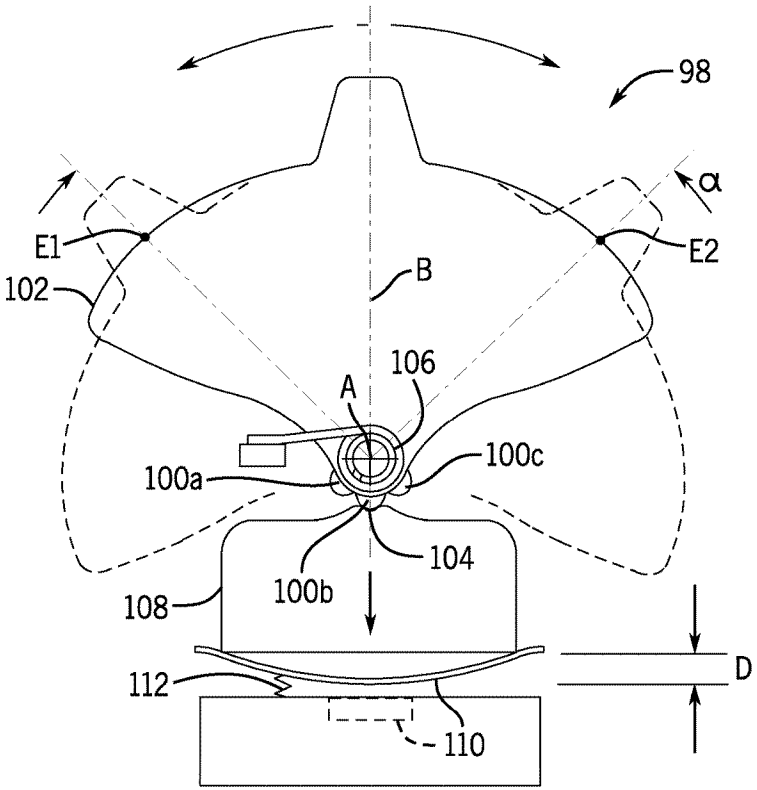
FIG. 12 is a graphical representation of an example depressible roller control having detent positions that may be incorporated into the operator controls of FIG. 2.

A simplified example of a depressible detent roller control 98 of this type will now be described with reference to FIG. 12. FIG. 12 depicts a roller control 98 having an example configuration that may be considered generic for any particular roller control used in the controls 54. While FIG. 12 depicts a single roller control, the features thereof may be part of one or more other roller controls to which the following description would apply, as modified as necessary (e.g., by referring to a "second" or "third" of each component or feature).

As shown schematically, the roller control 98 may be configured to have raised detent features 100*a*, 100*b*, 100*c* angularly spaced apart along a lower periphery of an upper switch part 102. The spacing of the detent features 100*a*, 100*b*, 100*c* may correspond to a center position C and end of travel positions $E_1$ and $E_2$ of the roller control 98. The center position C may fall along a line that bisects the reference pivot angle γ. The end of travel positions $E_1$ and $E_2$ may fall along reference lines coincident with lines defining the referenced pivot angle γ. Each detent feature 100*a*, 100*b*, 100*c* may be received in a recess 104 in a lower part of the roller control 98. The middle detent feature 100*b* is received in the recess 104 when in the roller control 98 is in the center position C. The detent features 100*a* and 100*c* are received in the recess 104 when in the end of travel positions $E_1$ and $E_2$ of the roller control 98. The roller control 98 may have springs (e.g., spring 106) or other biasing arrangement biasing the roller control 98 to return to the center position C after being rotated in either direction.

The detents may simply provide tactile feedback (or "feel") to the operator indicating when the control is moved to a known position within the range of movement, or the detents may be used to hold the roller control 98 in the associated position. Additionally or alternatively, the roller control 98 may be configured to act as a push-button when in one or more of the detent positions to send the controller 56 an additional "button" control input by shifting its axis of rotation (e.g., roller axis A) and moving a lower switch part 108 a distance D along the button axis B, which is normal to roller axis A, to engage electrical contacts 110. The roller control 98 may have shields or other structures (not shown) that prevent it from being depressed unless in one of the detent positions. A spring 112 or other biasing arrangement may be used to return the roller control 98 to its initial position, and thus to bias the electrical contacts 110 apart. In this way, the operator may be able to roll the control to the desired detent location and then depress the roller whereupon the control sends a signal to the controller 56 to effect the movement corresponding to the discrete control input at the associated detent position.

In this example, the roller control 98 will send variable control input signals to the controller 56 as the roller control 98 is rotated about the roller axis A. The roller control 98 will also provide one or more discrete control inputs when depressed, such as center, end of travel or any other preselected position control inputs. The discrete control inputs may be used to execute positioning operations that would otherwise require the operator to hold the roller control 98 at a steady rotational position for the duration of the operation cycle time. In this case, the controller 56 may be configured to interpret the discrete control inputs and execute control signals in any suitable manner to perform the commanded operations. By way of example, the controller 56 could initiate a counter and supply the control signal for a predetermined period of time corresponding to the nominal cycle time for that operation. Alternatively or additionally, the controller 56 could receive closed-loop feedback from one or more sensors associated with the actuator(s) or the machine- or implement-positioning components. Feedback from the sensors could then be interpreted by the controller 56 to terminate the control signal and the commanded operation. Operator input via the control interface 52 may be used to adjust the nominal cycle time, or even to define or refine the correlation of the detents and associated positioning operations.

The roller control 98, and the controller 56, may be configured to provide a return to center function (e.g., to center the chassis), or return to neutral function, by either rolling the roller control 98 to center, or by depressing down when centered. In the case of the articulation control 78*b*, the operator may push the roller fully forward, press down and release, and this will cause the motor grader 20 to articulate fully counter-clockwise. Then, with the articulation control 78*b* in the center position, the operator may simply press down to return the articulation joint 38, and the main frame 22, to its center position, thus freeing the operator of the time and concentration required to complete the operation. In this case, this single articulation control 78*b* could not only replace two dedicated clockwise rotate and counter-clockwise rotate controls, but also the chassis return to center control 74*b*.

Moreover, as described above, the articulation control 78*b* and the wheel lean control 80 may be positioned side by side with their individual roller axes aligned along a common axis, such as roller axis A, so that they may be manipulated simultaneously in a single motion. The functionality of roller control 98 may allow both chassis articulation and wheel lean operations to not only be more readily executed simultaneously, but also without requiring the operator to hold the controls 78*b*, 80*b* for the cycle time of both operations. Rather, when the operator wants to execute full wheel lean and full chassis articulation simultaneously, the operator need only roll both roller controls 78*b*, 80*b* to their end of travel positions, to engage the associated detents, and then press down on the controls 78*b*, 80*b* and release. Furthermore, centering the chassis and steered wheels may be accomplished by simply depressing the controls 78*b*, 80*b* when in their normally centered state. As noted above, a single one of the controls 78*b*, 80*b* could be used to initiate a center or end of travel command for both articulation and wheel lean.

It should be noted that the push-button movement of the roller control 98 could be used to send a discrete control input to the controller 56 to perform any secondary operation, be it related or unrelated to the rotational movement of the roller control, or the machine- or implement-positioning component controlled thereby. As such, the described example is not intended to be limiting. And, as mentioned, the example roller control switch hardware in FIG. 12 is schematic and illustrative only. Other switch configurations may be used, such as the one or more example configurations disclosed in co-owned and co-pending application Ser. No. 14/860,129 filed Sep. 21, 2015.

Example applications related to the circle and blade components, including circle rotation and blade positioning control will now be discussed, for which one or more detented controls may be incorporated into the operator control arrangement. The control hardware for these further example applications may be the same as described above with respect to the articulation and wheel lean features, and thus, the associated details will not be repeated here. It should also be understood that the control hardware could be different from the above-described example.

As one non-limiting example, the roller circle rotate control 80*a* may be a detented control having end of travel detents in each pivotal direction as well as a center detent between the ends of travel. Other, intermediate detent positions may also be incorporated. The circle rotate control 80*a* may provide control inputs to the controller 56 that control the circle drive, (not shown), which may be a suitable rotary drive motor for rotating the circle 40. Rotating the roller about its roller axis in either direction may cause the circle 40 to rotate in corresponding opposite rotational directions, and releasing the roller may cause the circle 40 to stop rotating and the circle rotate control 80*a* to return to its centered position. The controller 56 may be programmed and configured to interpret the control input from the circle rotate control 80*a* when moved to one of the detent positions as a command to control the circle drive to rotate the circle 40 to a predetermined rotation angle or clock position. This may be accomplished in various ways, including for example, storing an instruction set that the controller 56 accesses to determine the current angular position of the circle 40 (e.g., based on various sensor inputs), initiate a timer, and cycle the circle drive a predetermined time in order reach the stored position. Closed-loop or other feedback control may also be used. The center detent may correspond to a "center" position of the circle 40 in which the blade 42 is in a "center" position, which, for example, may be perpendicular to the main frame or at a typical operational orientation oblique to the main frame. The end of travel detents may correspond to clockwise and counter-clockwise rotational positions of the circle 40 in which the blade 42 is in "extreme" left and right angular orientations. Here, it will be understood, the "end of travel" positions of the circle 40 are artificial constructs based on the practical limits in angulation of the blade 42, either limited to the effective operational angles of the blade 42 or the space envelope provided for the blade 42, or both.

The system may be configured so that simply rolling the circle rotate control 80*a* to one of the detent positions, for example, one or both of the end of travel detent positions, would cause the controller 56 to command the associated preselected position. Instead, the control may be configured so that a secondary actuation, such as movement along a button or depression axis, would be required to effect the command. A combination of this may also be possible, in which, for example, rolling to the end of travel detents effects the preselected position commands, but a button press is required at the center detent to effect the center command.

Other aspects of the detent control functionality may be provided in the circle rotate context. For example, the controller 56 may be configured to correlate a control input from the circle rotate control 80*a* when in a detent position to an angular position of the circle 40 that corresponds with a mirror position of the blade 42 about a vertical plane through the centerline extending in the fore-aft direction of travel. This mirroring functionality is particularly useful for motor graders when making row passes in alternating directions. The controller 56 may also be configured such that actuation of the circle rotate control 80*a* commands another operation (other than circle rotation) when in a detent position. For example, a center detent may correspond to a blade lift or shift operation, such that the blade 42 is raised or lowered or shifted laterally to a preselected position (e.g., fully raised or shifted laterally), separately or in addition to rotating the circle 40 to "center" the blade 42.

In other applications associated with, or separate from, the circle rotate operations, the operator control arrangement may include detent controls to control other circle and blade positioning operations. For example, the circle shift and blade pitch controls 70*a*, 70*b* may be detented controls in which the controller 56 correlates control inputs at the detent positions with preselected lateral positions of the circle 40 and blade 42 and preselected fore-aft pitch positions of the blade 42. As in other applications, the preselected positions could be center, end of travel (i.e., extreme) or intermediate positions. In the illustrated example, the controls 70*a*, 70*b* are roller controls that may provide control inputs to continuously position the circle 40 and/or blade 42 as the controls are rolled between detents. And as in other example applications, reaching the detents may signal the controller 56 to command the preselected positioning, or a second, button press actuation may be made. The circle shift control 70*a*, for example, or another dedicated control, may have detent positions that correspond to preselected lateral positions of the blade 42 with respect to the main frame of the machine and/or the circle 40. For example, the control may provide control inputs to the controller 56 to move associated actuators that slide or shift the blade 42 laterally with respect to the circle 40, and detent positions may then correspond to center, extreme end of travel or other intermediate positions of the blade 42 in either left/right lateral direction.

Other applications may benefit from incorporating detents in the joystick movements in one or both of the LOC 54*a* and ROC 54*b*. In another blade lift application, for example, such that the blade 42 is raised or lowered to one or more preselected positions, the LOC 54*a* and ROC 54*b* may each incorporate detent position(s) which correspond to preselected positions, such as a fully raised position corresponding to an end of travel detent position in each control 54*a*, 54*b*. As described above, the LOC 54*a* and ROC 54*b* each raise and lower a corresponding end of the blade 42 by pivotal movement about the X axis (in the Y direction). Pivoting the controls 54*a*, 54*b* will cause the associated ends of the blade 42 to raise or lower. Pivoting one or both of the controls 54*a*, 54*b* to end of travel detents may instruct the controller 56 to command the associated actuator (e.g., hydraulic cylinder) to extend or retract as needed to position the blade 42 in the fully raised position. Since the control arrangement, such as described herein, may have separate controls for each end of the blade 42, both controls 54*a*, 54*b* may need to be moved to detent positions. Alternatively, the controller could be configured so that moving only one of the controls to a detent position effects positioning of both ends of the blade 42. A separate "mode" or other control may be included to set whether the detent positioning controls both ends or only the associated end of the blade 42. This selection may be also made by a secondary actuation of the controls 54*a*, 54*b*, such as by movement along an associated button or depression axis, such as a "Z" axis, normal to the X and Y axes. Again, multiple detents, such as center and opposite ends of travel detents, may incorporated into such controls, and other detent functionality may be provided, including, for example, IGC mode control. One or more detents for various functions may be incorporated into the controls within pivotal movement (e.g., a twisting motion) about the Z axis as well.

As with other aspects of the disclosure, the detent control functionality should not be limited to the specific applications described. Similar functionality could readily be incorporated into controls for other motor grader operations than for the articulation, wheel lean, circle rotate, blade shift and blade lift components of the implement described. Moreover, this functionality of the disclosed control arrangement could also be incorporated in other vehicle platforms, such as crawler dozers, loaders, backhoes, skid steers and other agricultural, construction and forestry vehicles and implements. For example, a detent control could be used for blade positioning functions in a dozer application or to provide "flow lock" functionality in various loader, skid steer and other machine platforms to maintain a set hydraulic flow or pressure in the hydraulic system once a positioning operation was performed. As in the example described above, this relieves the operator of maintaining a steady control input, thereby freeing the operator's time and concentration for other tasks as well as improving the control accuracy.

Figure 10:
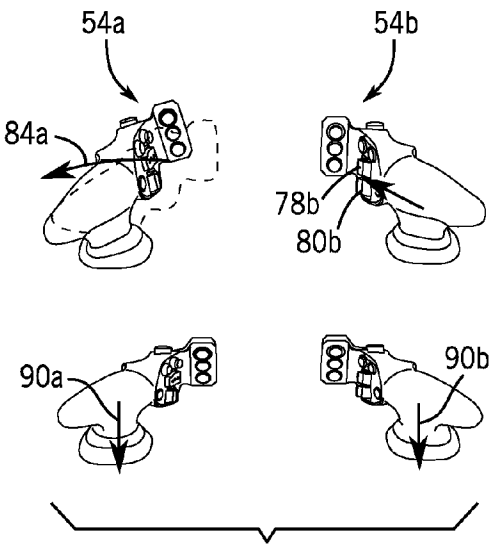
FIG. 10 is a graphical representation of movements and switch actuations for left and right operator controls to effect the reverse turn operation of FIG. 8 using the operator controls of FIG. 2.
Figure 8:
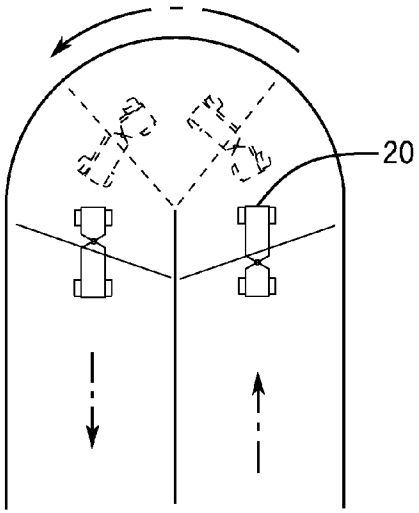
FIG. 8 is a graphical representation of an end of row reverse turn operation of the motor grader of FIG. 1.
Figure 9:
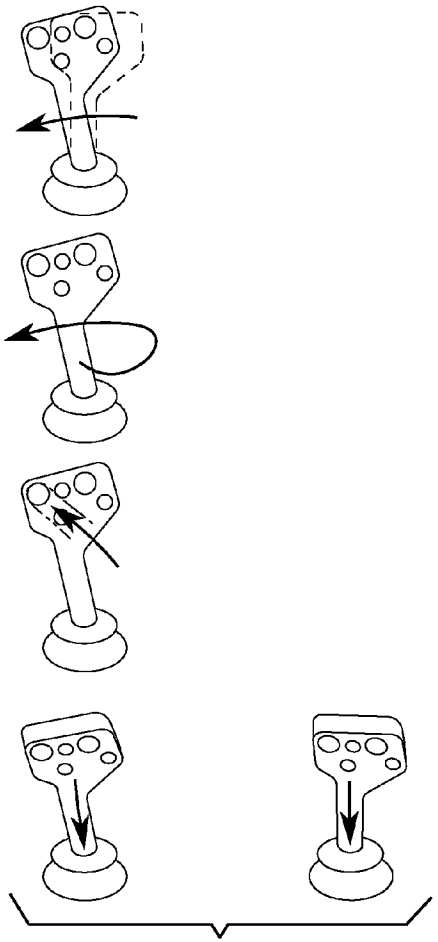
FIG. 9 (PRIOR ART)
FIG. 9 is a graphical representation of movements and switch actuations for left and right operator controls to effect the reverse turn operation of FIG. 8 using example prior art operator controls.

Referring now also to FIGS. 9-10, a specific example of an end of row, or reverse turn, operation in a motor grader will be discussed to further highlight various aspects of the disclosed operator control arrangement. FIG. 8 depicts schematically the common scenario for work vehicles such as motor grader 20, in which after making one straight pass over the ground to the end of a row, the motor grader 20 is required to turn back in the opposite direction. Given the long wheel base of the motor grader 20 in order to complete this operation, the operator will typically be required to control simultaneously or in rapid succession three machine-positioning components (in addition to controlling vehicle speed), namely the steering angle (direction) of the steered wheels 28, the lean angle of the steered wheels 28, and the articulation angle of the main frame 22. At the same time, the operator may also need to control one or more implement-positioning components, including, at minimum the pivot angle of the blade 42. Presuming that these are the only four operations that need to be performed simultaneously, the control inputs executed by the operator will now be considered first with respect to an example prior art pistol-grip type dual joystick control arrangement (as shown in FIG. 9), and then with respect to the disclosed control arrangement (as shown in FIG. 10).

Referring to FIG. 9, an operator using the depicted prior art dual joystick control arrangement to execute an end of turn operation would pull back on both joysticks to lift both ends of the blade. At the same time, the operator would: (i) apply his or her left thumb to a wheel lean button to lean the steered wheels leftward, (ii) perform a twisting movement of the left joystick to articulate the chassis, and (iii) pivot the left joystick to the left to steer the wheels left. From this, at least the following can be observed. First, since the articulation control input and the steering input both require pivoting of the same joystick, these operations cannot be controlled simultaneously, but rather must be implemented consecutively and in rapid succession. Second, the operator's left hand is called upon to make nearly all (save one) of the control inputs, including a rather contorted wrist movement to articulate the chassis and an unnatural reverse reach of the left thumb to lean the wheels.

Referring now to FIG. 10, an operator using the disclosed control arrangement would pull back on both the LOC 54*a* and the ROC 54*b* to lift both ends of the blade 42 (FIG. 1). At the same time, the operator would use the LOC 54*a* to turn the steered wheels 28 (FIG. 1) to the left and use the ROC 54*b* to articulate the chassis and lean the steered wheels 28 leftward. From this, the benefits of the disclosed operator control arrangement are clear. First, control inputs for all of the operations can be executed simultaneously. Second, the work load is evenly distributed between the operator's left and right hands, and only simple, natural motions are needed. Instead of contorting one's wrist and thumb, using the disclosed control arrangement, the operator may use a single motion of the right thumb to articulate the chassis and lean the wheels. Further, in the event that the articulation control 78*b* and the wheel lean control 80*b* incorporate functional detents, the operator would merely roll the controls to the end of their ranges of motion and release, and then after the turn, re-center the chassis and wheel lean by simply pressing down on the controls, again in a single thumb motion, however, this time using a single push-button, depress motion.

Continuing, in addition to simplifying operation and reducing operator fatigue, aspects of the disclosed operator controls may enhance the precision and accuracy of certain operations. For example, certain short duration or short distance adjustments may be difficult for the operator to execute using standard operator controls. Rather than controlling to the intended adjusted position, the operator may be forced to over-shoot and under-shoot the intended position repeatedly until properly adjusted, if it is even possible at all. As mentioned, imprecise positioning may have costly consequences in terms of time inefficiency and material waste, which may be considerable when considered in the aggregate.

An incremental advance aspect of the disclosed operator control arrangement will now be described for an example blade height adjustment operation, with respect to both a manual mode and an IGC mode of operation. It should be understood that this example is not limiting, and that such incremental advance functionality could apply to blade height control in other ways, or to control other components of the motor grader 20, other motor graders or other vehicle platforms. Moreover, the following description describes the incremental blade height adjustment with respect to a two-cylinder lift assembly, however, other arrangements could be employed, including, for example, a three-cylinder power angle tilt arrangement. Generally, the incremental advance functionality effects a stepped positional adjustment of a pre-determined amount (e.g., distance, time, etc.) independent of the dwell time of the control input provided by the operator.

Referring to FIGS. 4A-4B, 5 and 11A-11C, the IGC controls 92, 94 and 96 of the controls 54 may be used to provide an incremental advance blade height adjustment for the motor grader 20. In particular, in a manual mode of operation, depressing either the IGC up control 94*a*, 94*b* or the IGC down control 96*a*, 96*b* will signal the controller 56 to control the associated lift actuator 34*a*, 34*b* to raise or lower the circle 40, and thereby the blade 42. The IGC up control 94*a* and the IGC down control 96*a* of the LOC 54*a* will retract and extend the left lift actuator 34*a* to raise and lower the circle 40 at a left side of the main frame 22, and thereby raise and lower a left end of the blade 42. Similarly, the IGC up control 94*b* and the IGC down control 96*b* of the ROC 54*b* will retract and extend the right lift actuator 34*b* to raise and lower the circle 40 at a right side of the main frame 22, and thereby raise and lower a right end of the blade 42.

Figure 11B:
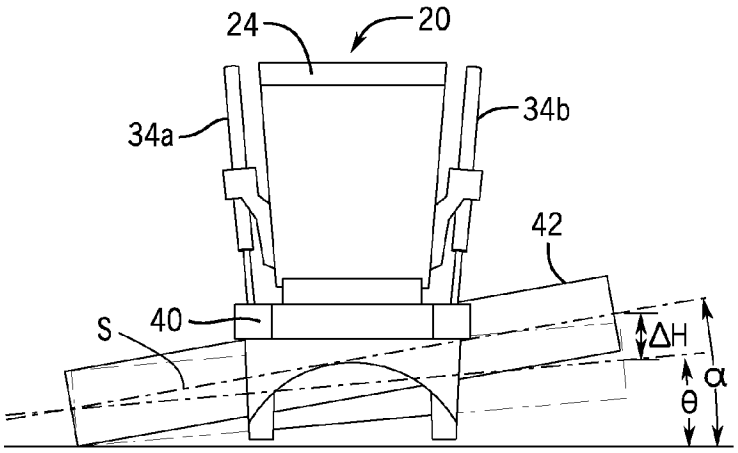
FIGS. 11A-11C are graphical representations of example blade height and slope adjustments that may be carried out using incremental advance functionality of the operator controls of FIG. 2.
Figure 11A:
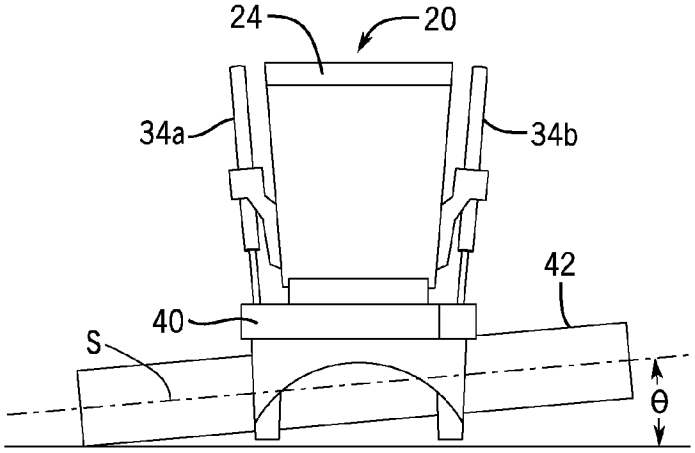

The controller 56 may be configured to interpret an IGC up/down control input and generate a corresponding control signal to the electro-hydraulic valve controlling hydraulic fluid to the lift actuators 34*a*, 34*b* that is of a prescribed duration. Alternatively or additionally, the controller 56 may be configured to receive closed-loop feedback from one or more sensors associated with the control valves and lift actuators 34*a*, 34*b* to terminate the control signal upon receiving feedback that the incremented adjustment has been reached. In the manual mode of operation, the controller 56 will process control inputs from any of the IGC controls, and will advance the position of either or both of the lift actuators 34*a*, 34*b* simultaneously or consecutively independent of the other control input or the height of either side of the circle 40 or the either end of the blade 42. Thus, in the manual mode of operation, the operator can control whether the blade height is changed uniformly so that a slope S of the blade 42 from end to end does not change, or whether the slope of the blade 42 is changed. For example, as shown in FIG. 11B, an incremental change in height ΔH of the right end of the blade 42, without changing the height of the left end of the blade 42, may cause the slope S of the blade 42 to change from its prior angle θ (see FIG. 11A) to a new angle α, for example, with respect to the main frame 22 or the ground.

Figure 11C:
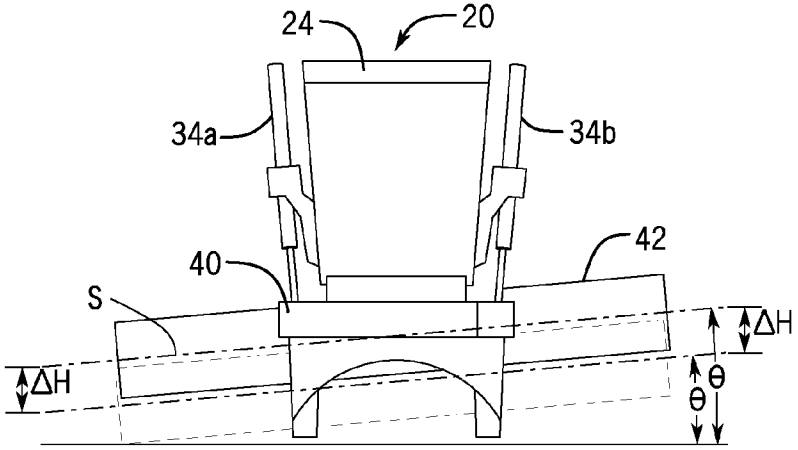

In the IGC or "cross-slope" control mode of operation, the controller 56 works to maintain a constant slope of the blade 42. As described above, IGC mode is activated and deactivated by depressing either IGC mode control 92*a*, 92*b*. Once depressed, the controller 56 sets up a master-slave control relationship in which the LOC 54*a* or ROC 54*b* associated with which IGC mode control 92*a*, 92*b* was depressed, acts as the master, and the other acts as the slave. In this way, the IGC up control 94*a*, 94*b* and the IGC down control 96*a*, 96*b* specified as the master may be used to raise or lower (by the incremental change in height ΔH) the circle 40, and thereby the blade 42, at the associated side (i.e., left or right) of the machine by actuating the associated lift actuator 34*a*, 34*b*. The other, slave set of IGC up/down controls will be disabled temporarily and the controller 56 will control the associated lift actuator as needed to maintain the slope S of the blade 42 in the state it was before the IGC mode was activated. For example, if the IGC mode control 92*a* of the LOC 54*a* was depressed, the IGC up control 94*b* and IGC down control 96 would be disabled. Pressing the IGC up control 94*b* would generate a control input to the controller 56 to advance the left and right lift actuators 34*a*, 34*b* by the same predetermined increment ΔH, and pressing the IGC down control 96 would generate a control input to the controller 56 to advance the left and right lift actuators 34*a*, 34*b* by the same predetermined decrement ΔH. In so doing, as shown in FIG. 11C, the slope S of the blade 42 remains held at the same angle θ with respect to the main frame 22 that the blade 42 was at prior to the increment or decrement, shown in FIG. 11A. In both the manual and IGC modes, multiple successive up/down control inputs would generate successive incremental height adjustments, each equal to ΔH.

The control used to input an increment or decrement advance may be a push-button switch, as shown. However, any other switch hardware could be used, including a proportional roller or joystick control. In this case, an analog, variable impulse input, such as a "flick" of the roller or a joystick "jab", may be interpreted by the controller 56 as a discrete incremental advance input. Thus, the control need not be a dedicated increment/decrement control, but rather could be a general raise/lower control in which during manual or IGC (or other) operational mode, the control may be held for any desired duration to move the implement any (non-incremental or non-step-wise) distance. Then, upon receiving an impulse input to that same control, the incremental advance functionality may be invoked by the controller 56. The incremental input may also be provided by detented controls, for example, in which at detented positions successive button-press actuations of the controls along depression axes may increment or decrement the blade.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that any use of the terms "comprises" and/or "comprising" in this specification specifies the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various implementations other than those explicitly described are within the scope of the claims.

What is claimed is:

1. A control system for a work vehicle having an implement adjustably mounted to a frame of the work vehicle by a first actuator coupled to the implement and a second actuator coupled to the implement, the control system comprising:

at least one controller configured to adjust the first actuator and the second actuator;

a first operator control of a first operator control device providing a first incremental input to the at least one controller corresponding to a first incremental adjustment of the first actuator, the first incremental adjustment effecting a prescribed change in position of a first side of the implement; and a second operator control of a second operator control device providing a second incremental input to the at least one controller corresponding to a second incremental adjustment of the second actuator, the second incremental adjustment effecting a prescribed change in position of a second side of the implement;

wherein, at least when in a manual control mode, the incremental change in position of the first side of the implement is independent of the incremental change in position of the second side of the implement.

2. The control system of claim 1, wherein the first incremental input is one of a prescribed incremental height increase of the first side of the implement and a prescribed incremental height decrease of the first side of the implement; and wherein the second incremental input is one of a prescribed incremental height increase of the second side of the implement and a prescribed incremental height decrease of the second side of the implement.

3. The control system of claim 1, wherein the first and second operator control devices are respective first and second joysticks; and wherein the first and second operator controls are joystick controls providing the impulse inputs by pivotal movement of the respective first and second joysticks.

4. The control system of claim 2, wherein the first and second operator controls are respective first and second switch sets;

wherein the first switch set includes a first increment button associated with the prescribed incremental height increase of the first side of the implement and includes a first decrement button associated with the prescribed incremental height decrease of the first side of the implement; and wherein the second switch set includes a second increment button associated with the prescribed incremental height increase of the second side of the implement and includes a second decrement button associated with the prescribed incremental height decrease of the second side of the implement.

5. The control system of claim 1, wherein the first and second operator controls are configured to provide variable inputs including impulse inputs; and wherein the controller is configured to interpret the impulse inputs as one or more of the first and second incremental inputs.

6. The control system of claim 1, further comprising a third operator control providing a mode selection input to the controller for changing between the manual control mode and a cross-slope control mode.

7. The control system of claim 6, wherein, when the third operator control is in the manual mode, the first operator control is configured so that the first incremental input to the controller corresponding to the first incremental adjustment of the first actuator effects a prescribed change in height of the first side of the implement, and the second operator control is configured so that the second incremental input to the controller corresponding to the second incremental adjustment of the second side of the second actuator effects a prescribed change in height of the second side of the implement independent of the change in position of the first side of the implement; and wherein, when the third operator control is in the cross-slope control, the first operator control is configured so that the first and second incremental inputs to the controller corresponding to the first and second incremental adjustments of the first and second actuators effect a prescribed change in height of the implement without changing a slope of the implement between the first and second sides.

8. The control system of claim 7, wherein the first and second operator controls are respective first and second switch sets;

wherein the first switch set includes a first increment button associated with a prescribed incremental height increase of the first side of the implement and includes a first decrement button associated with a prescribed incremental height decrease of the first side of the implement;

wherein the second switch set includes a second increment button associated with a prescribed incremental height increase of the second side of the implement and includes a second decrement button associated with a prescribed incremental height decrease of the second side of the implement;

wherein, when the third operator control sets the controller to the manual control mode, the first increment and decrement buttons and the second increment and decrement buttons are configured to provide independent incremental height adjustments to the respective first and second sides of the implement; and wherein, when the third operator control sets the controller to the cross-slope control mode, the first and second switch sets are configured in a coordinated relationship in which only the first increment and decrement buttons provide inputs to the controller for incremental height adjustments of the first and second sides of the implement that maintain the slope of the implement between the first and second sides.

9. A control system for a work vehicle having an implement adjustably mounted to a frame of the work vehicle by a first actuator coupled to a first side of the implement and a second actuator coupled to a second side of the implement, the control system comprising:

a controller configured to adjust the first actuator and the second actuator;

a first operator control of a first operator control device providing a first incremental input to the controller corresponding to a first incremental adjustment of the first actuator, the first incremental adjustment effecting a prescribed change in height of the first side of the implement; and a second operator control of a second operator control device providing a second incremental input to the controller corresponding to a second incremental adjustment of the second actuator, the second incremental adjustment effecting a prescribed change in height of the second side of the implement;

wherein, at least when in a manual control mode, the incremental change in height of the first side of the implement is independent of the incremental change in height of the second side of the implement.

10. The control system of claim 9, wherein the first and second operator controls are configured to provide respective first and second impulse inputs;

wherein the first impulse input is associated with one of the prescribed incremental height increase and prescribed incremental height decrease of the first side of the implement; and wherein the second impulse input is associated with one of the prescribed incremental height increase and prescribed incremental height decrease of the second side of the implement.

11. The control system of claim 10, wherein the first and second operator control devices are part of respective first and second joysticks; and wherein the first and second operator controls are joystick controls providing the first and second impulse inputs by pivotal movement of the respective first and second joysticks.

12. The control system of claim 10, wherein the first and second operator controls are respective first and second switch sets;

wherein the first switch set includes a first increment button associated with the prescribed incremental height increase of the first side of the implement and includes a first decrement button associated with the prescribed incremental height decrease of the first side of the implement; and wherein the second switch set includes a second increment button associated with the prescribed incremental height increase of the second side of the implement and includes a second decrement button associated with the prescribed incremental height decrease of the second side of the implement.

13. The control system of claim 10, further comprising a third operator control providing a mode selection input to the controller for changing between the manual control mode and a cross-slope control mode.

14. The control system of claim 13, wherein, when the third operator control sets the controller to the manual control mode, the first operator control is configured so that the first incremental input to the controller corresponding to the first incremental adjustment of the first actuator effects a prescribed change in height of the first side of the implement, and the second operator control is configured so that the second incremental input to the controller corresponding to the second incremental adjustment of the second side of the second actuator effects a prescribed change in height of the second side of the implement independent of the change in position of the first side of the implement; and wherein, when the third operator control sets the controller to the cross-slope control mode, the first operator control is configured so that the first and second incremental inputs to the controller corresponding to the first and second incremental adjustments of the first and second actuators effect a prescribed change in height of the implement without changing a slope of the implement between the first and second sides.

15. The control system of claim 14, wherein the first and second operator controls are respective first and second switch sets;

wherein the first switch set includes a first increment button associated with a prescribed incremental height increase of the first side of the implement and includes a first decrement button associated with a prescribed incremental height decrease of the first side of the implement;

wherein the second switch set includes a second increment button associated with a prescribed incremental height increase of the second side of the implement and includes a second decrement button associated with a prescribed incremental height decrease of the second side of the implement;

wherein, when third operator control sets the controller to the manual control mode, the first increment and decrement buttons and the second increment and decrement buttons are configured to provide independent incremental height adjustments to the respective first and second sides of the implement; and wherein, when third operator control sets the controller to the cross-slope control mode, the first and second switch sets are configured in a coordinated relationship in which only the first increment and decrement buttons provide inputs to the controller for incremental height adjustments of the first and second sides of the implement that maintain the slope of the implement between the first and second sides.

16. A control system for a work vehicle having an implement adjustably mounted to a frame of the work vehicle by a first actuator coupled to a first side of the implement and a second actuator coupled to a second side of the implement, the control system comprising:

a controller configured to adjust the first actuator and the second actuator;

a first joystick having a first operator control providing a first incremental input to the controller corresponding to a first incremental adjustment of the first actuator; and a second joystick having a second operator control providing a second incremental input to the controller corresponding to a second incremental adjustment of the second actuator;

a third operator control providing a mode selection input to the controller for changing between a manual control mode and a cross-slope control mode;

wherein, when the third operator control sets the controller to the manual control mode, the first operator control is configured to provide a first incremental input to the controller corresponding to a first incremental adjustment of the first actuator effecting a prescribed change in height of the first side of the implement, and the second operator control is configured to provide a second incremental input to the controller corresponding to a second incremental adjustment of the second side of the second actuator effecting a prescribed change in height of the second side of the implement independent of the change in position of the first side of the implement; and wherein, when the third operator control sets the controller to the cross-slope control, the first operator control is configured to provide first and second incremental inputs to the controller corresponding to first and second incremental adjustments of the first and second actuators effecting a prescribed change in height of the implement without changing a slope of the implement between the first and second sides.

17. The control system of claim 16, wherein the first and second operator controls are configured to provide respective first and second impulse inputs by pivotal movement of the respective first and second joysticks;

wherein the first impulse input is associated with one of the prescribed incremental height increase and prescribed incremental height decrease of the first side of the implement; and wherein the second impulse input is associated with one of the prescribed incremental height increase and prescribed incremental height decrease of the second side of the implement.

18. The control system of claim 16, wherein the first and second operator controls are respective first and second switch sets;

wherein the first switch set includes a first increment button associated with the prescribed incremental height increase of the first side of the implement and includes a first decrement button associated with the prescribed incremental height decrease of the first side of the implement; and wherein the second switch set includes a second increment button associated with the prescribed incremental height increase of the second side of the implement and includes a second decrement button associated with the prescribed incremental height decrease of the second side of the implement.

19. The control system of claim 18, wherein, when third operator control sets the controller to the manual control mode, the first increment and decrement buttons and the second increment and decrement buttons are configured to provide independent incremental height adjustments to the respective first and second sides of the implement; and wherein, when third operator control sets the controller to the cross-slope control mode, the first and second switch sets are configured in a coordinated relationship in which only the first increment and decrement buttons provide inputs to the controller for incremental height adjustments of the first and second sides of the implement that maintain the slope of the implement between the first and second sides.

20. The control system of claim 16, wherein the work vehicle is one of a motor grader and a crawler dozer; and wherein the implement is a blade.

* * * * *